US008064790B2

(12) United States Patent
Takahashi

(10) Patent No.: US 8,064,790 B2
(45) Date of Patent: Nov. 22, 2011

(54) INFORMATION FORMING APPARATUS HAVING A VARIABLE POWER FIXING UNIT

(75) Inventor: Zenji Takahashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 502 days.

(21) Appl. No.: 12/241,115

(22) Filed: Sep. 30, 2008

(65) Prior Publication Data

US 2009/0123171 A1 May 14, 2009

(30) Foreign Application Priority Data

Nov. 8, 2007 (JP) ..... 2007-290348

(51) Int. Cl.
*G03G 15/00* (2006.01)

(52) U.S. Cl. ..... 399/88

(58) Field of Classification Search ..... 399/88, 399/44, 45, 67, 68, 69
See application file for complete search history.

(56) References Cited

U.S. PATENT DOCUMENTS

2005/0139584 A1* 6/2005 Kishi et al. ..... 219/202

FOREIGN PATENT DOCUMENTS

| | | | |
|---|---|---|---|
| JP | 55-147654 | A | 11/1980 |
| JP | 05-307340 | A | 11/1993 |
| JP | 11327350 | A | 11/1999 |
| JP | 2004-219503 | A | 8/2004 |

* cited by examiner

*Primary Examiner* — Quana M Grainger
(74) *Attorney, Agent, or Firm* — Panitch Schwarze Belisario & Nadel LLP

(57) ABSTRACT

An invented image forming apparatus includes a fixing unit for fixing a developer image transferred onto a conveyed medium; a temperature detecting unit for detecting a temperature of said fixing unit, a first power supply controller for controlling power supply to said fixing unit based on the detected result of the temperature detecting unit, a second power supply controller for controlling power supply to said fixing unit based on a preset value, a medium detection unit for detecting a medium to be conveyed, and a power supply operation controller for switching control done between said first power supply controller and said second power supply controller based on a position of the medium detected with said medium detection unit. The image forming apparatus can reduce impairment of settling rate of the developer images at the second half of the recording paper during the fixing process.

11 Claims, 17 Drawing Sheets

INFORMATION FORMING APPARATUS HAVING A VARIABLE POWER FIXING UNIT

BACKGROUND OF THE INVENTION

1. Field of the Invention

This invention relates to an image forming apparatus having a fixing unit.

2. Description of Related Art

Prior art image forming apparatuses such as electrophotographic printers heat a heating roller by generating heat at the heater equipped inside the heat roller, and fix the transferred developer image onto a medium such as recording paper using the heat. Such an image forming apparatus having the fixing unit generally includes a temperature control unit to keep the surface temperature of the heat roller at a prescribed temperature. Such a temperature control unit controls the heater based on detected results of the surface temperature with a proper temperature detection unit such as, e.g., thermistor and keeps the surface temperature of the heat roller at the prescribed temperature. Japanese Unexamined patent publication Heisei No. 11-327350 discloses such an art.

In this prior art, the temperature control unit makes the heater generate heats by turning on power supply to the heater where the temperature detection unit detects that the surface temperature of the heat roller is at a fixable temperature or below. The temperature control unit halts heat generation with the heater by turning off the power supply to the heater where the temperature detection unit detects that the surface temperature of the heat roller is at a fixable temperature or above.

Referring to FIG. 17, the prior art temperature control unit operates a feedback control entering heater #1 signal at a time when the temperature detection unit detects the lowered surface temperature of the heat roller constituting the fixing unit, or namely, at timings B1, B3, B5.

As shown in FIG. 17, where continuing printing is operated at the prior art image forming apparatus, however, the surface temperature of a backup roller is increased because the heat retained at the heat roller is transmitted to the backup roller by direct contacting the heat roller heated by the heater with the backup roller until an Nth page of the recording paper reaches the nipping portion after the N−1 page of the recording paper passes by the nipping portion formed with the contacting surface between the heat roller and the backup roller. The heat retained at the heat roller and the backup roller dissipates to the recording paper where the first half of the Nth page of the recording paper passes through the nipping portion, so that the surface temperature of the heat roller and the backup roller decreases. Therefore, this operation surely secures the first half of the Nth page of the recording paper, but brings a result that the second half of the Nth page of the recording paper is not fixed adequately. In addition, the second half of the Nth page of the recording paper is still not fixed well even where the temperature control unit outputs the heat #1 signal at the timings B1, B3, B5, because time lag exists before the heat roller is actually heated.

It is an object of the invention to provide an image forming apparatus reducing occurrences of impaired fixing of developer images at the second half of the recording paper during a fixing step done by a fixing unit.

SUMMARY OF THE INVENTION

To accomplish the foregoing objects, the image forming apparatus according to this invention includes a fixing unit for fixing a developer image transferred onto a conveyed medium, a temperature detecting unit for detecting a temperature of said fixing unit, a first power supply controller for controlling power supply to said fixing unit based on the detected result of the temperature detecting unit, a second power supply controller for controlling power supply to said fixing unit based on a preset value, a medium detection unit for detecting a medium to be conveyed, and a power supply operation controller for operating said second power supply controller based on a position of the medium detected with said medium detection unit.

In another aspect of the invention, an image forming apparatus includes a fixing unit for fixing a developer image transferred onto a conveyed medium, a temperature detecting unit for detecting a temperature of said fixing unit, a first power supply controller for controlling power supply to said fixing unit based on the detected result of the temperature detecting unit, a second power supply controller for controlling power supply to said fixing unit based on a preset value, a medium detection unit for detecting a medium to be conveyed, and a power supply operation controller for switching control done between said first power supply controller and said second power supply controller based on a position of the medium detected with said medium detection unit.

BRIEF DESCRIPTION OF THE DRAWINGS

The above and other objects, features and advantages of the present invention will become more apparent from the following description of the presently preferred exemplary embodiments of the invention taken in conjunction with the accompanying drawing, in which.

DESCRIPTION OF PREFERRED EMBODIMENTS OF THE INVENTION

First Embodiment

Figure 1:
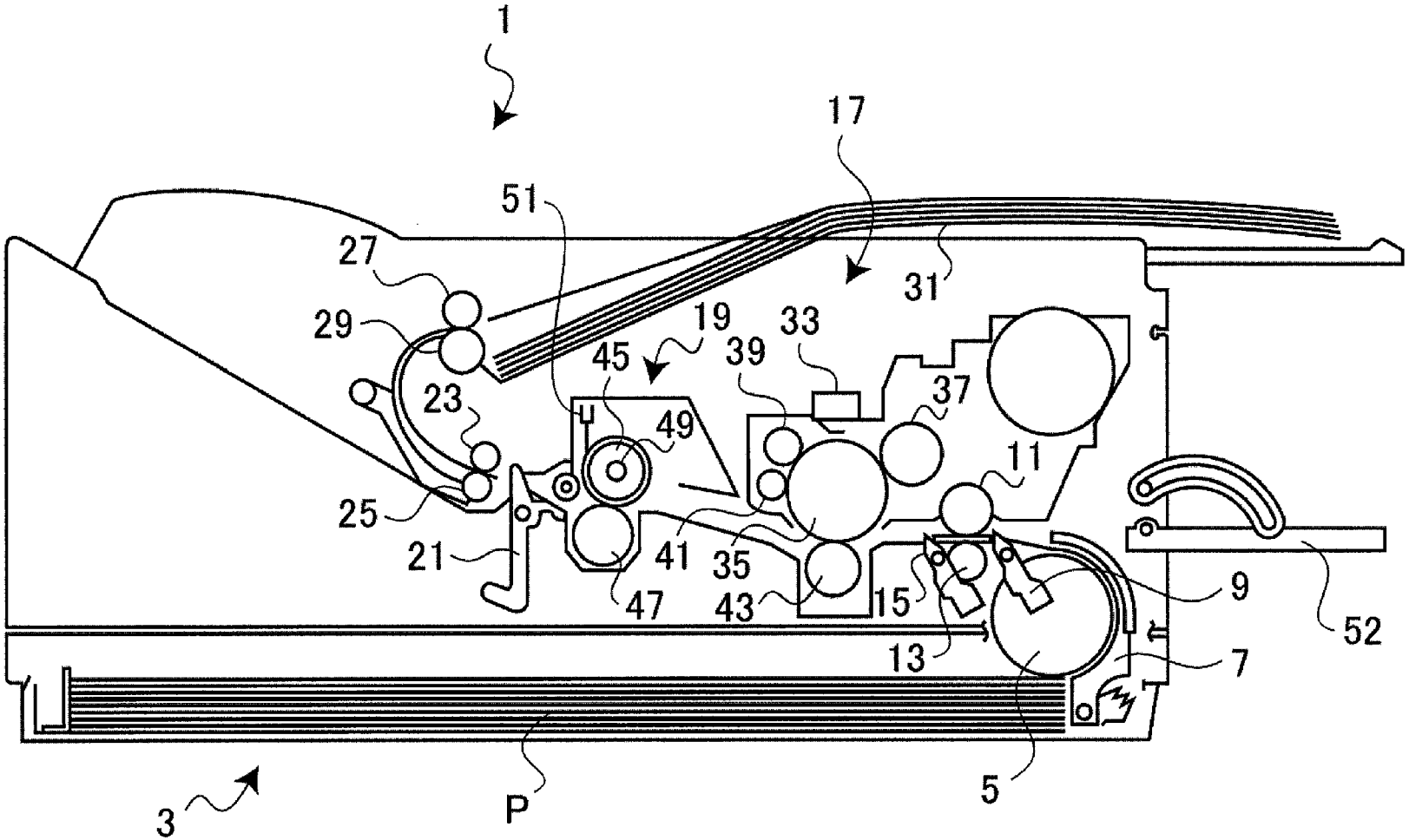
FIG. 1 is a schematic diagram showing an essential structure of a printer according to a first embodiment of the invention.

Referring to FIG. 1, an essential structure of an image forming apparatus according to the first embodiment of the invention is shown. A printer 1 serving as an image forming apparatus includes a stacker 3, a feeding roller 5, a separation frame 7, a paper feeding sensor 9, a conveyance roller 11, a registration roller 13, a writing sensor 15 serving as a medium detection unit, a developing unit 17, a fixing unit 19 serving as a fixing means, a delivery sensor 21, a delivery roller 23, a registration roller 25, a delivery roller 27, a registration roller 29, a stacker 31, an exposing unit 33, and paper P serving as a medium.

The developing unit 17 includes a photosensitive drum 35 serving as an image carrier, a developing roller 37 for forming developer images by attaching a developer to electrostatic latent images exposed on the photosensitive drum 35, a charging roller 39 for charging the surface of the photosensitive drum 35 at a prescribed potential, and a cleaning roller 41 for removing the developer remaining on the photosensitive drum 35.

Figure 2:
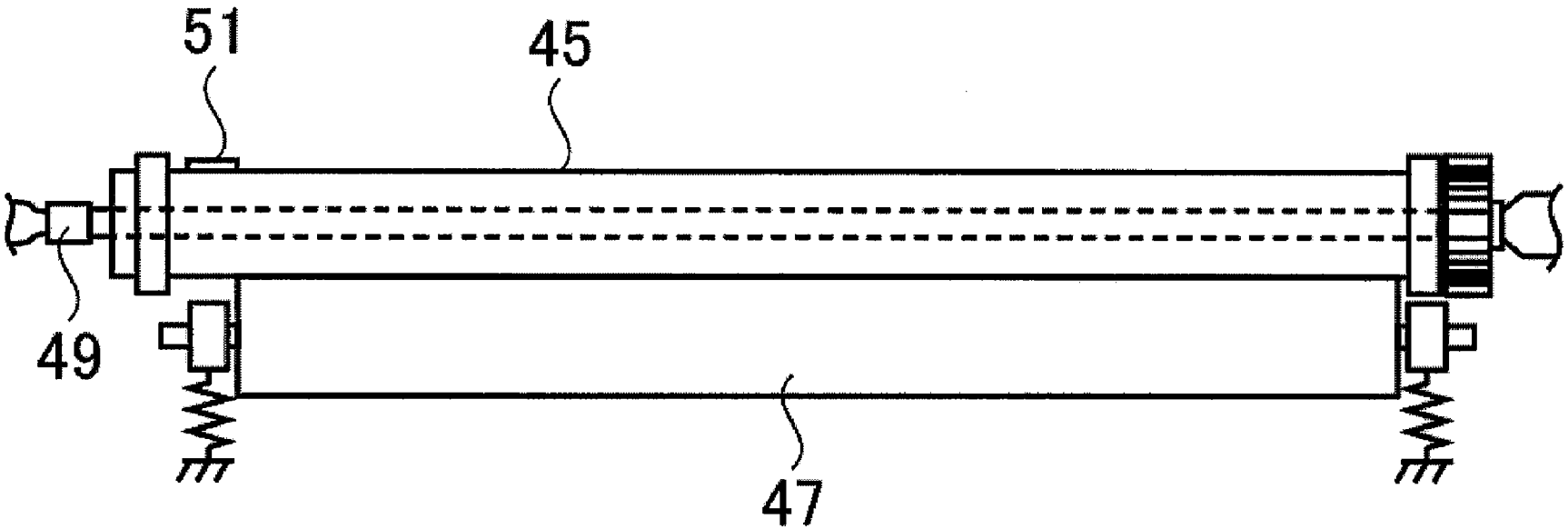
FIG. 2 is an illustration showing a fixing unit according to the first embodiment of the invention.

The fixing unit 19 includes a heat roller 45 and a backup roller 47. The heat roller 45 is equipped inside with a heater 49 for generating heat based on electric power supplied from a power supply unit as shown in FIG. 2 and described later, and the heater 49 heats up the surface of heat roller 45 by generating heat. The backup roller 47 fixes on the paper P the developer image formed on the paper P by conveying the paper P in a sandwiching manner with the heat roller 45.

The fixing unit 19 includes a thermistor 51 serving as a temperature detection unit at the heat roller 45. The thermistor 51 detects the surface temperature of the heat roller 45 heated by the heater 49 and supplies the detected result to a controller described below. The thermistor 51 is provided near an end of the heat roller 45 at which the paper P hardly absorbs heat.

The exposing unit 33 is constituted of, e.g., an arrangement of LED arrays. The exposing unit 33 makes exposure based on image information received from a personal computer serving as information processing apparatus not shown, and forms electrostatic latent images on the surface of the photosensitive drum 35 formed in the developing apparatus 17.

Figure 3:
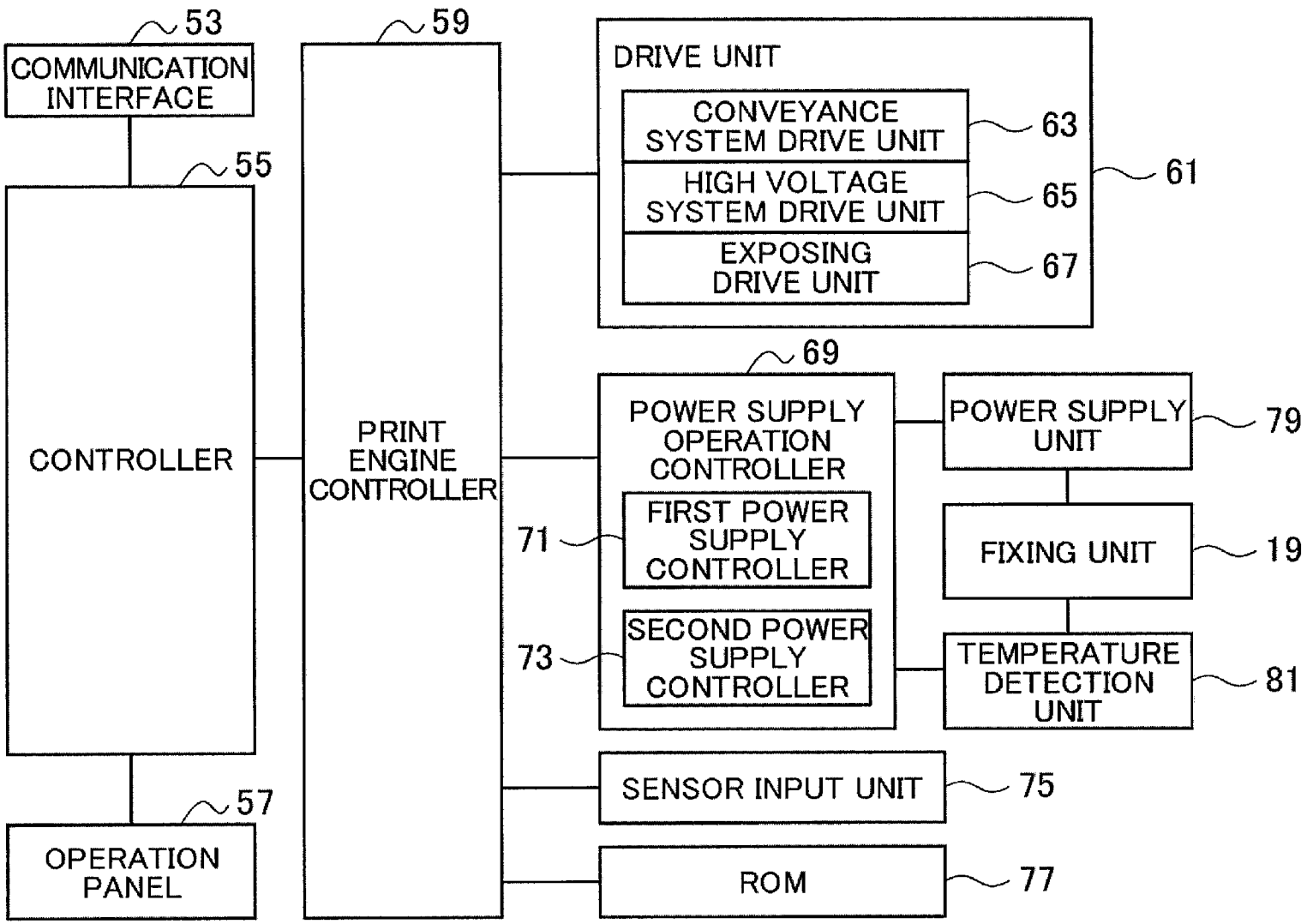
FIG. 3 is a block diagram showing a control system structure of the printer according to the first embodiment of the invention.

Referring to FIG. 3, a controlling system of the printer 1 is described. FIG. 3 is a block diagram illustrating the control system structure of the printer 1. The printer 1 includes a communication interface (I/F) 53 for communicating with personal computers (PC) as information processing apparatuses, a controller 55 for controlling respective units constituting the printer 1 based on a prescribed operation result, an operation panel 57 for providing instructions directly from a user and for showing predetermined information to the user, a printing engine controller 59 for controlling each portion of the printers during the printing process under the control of the controller 55, a drive unit 61 for controlling a power supply system of high voltages of various types, a power supply operation controller 69 for controlling power supply fed to the fixing unit 19, a sensor input unit 75 for supplying, to the print engine controller 59, data or signals such as detection results provided from various sensors such as the writing sensor 15, a ROM (read only memory) 77 for storing various programs for driving the printer 1 and storing a variety of information, a power supply unit 79 for supplying electric power to the fixing unit 19 under the control of the power supply operation controller 69, and a temperature detection unit 81 for providing to the power supply operation controller 69 the surface temperature of the heat roller 45 detected with the thermistor 51.

The drive unit 61 includes a conveyance system drive unit 63 for driving the feeding roller 5, the conveying roller 11, the delivery roller 23, and the delivery roller 27 for conveying the paper P along the medium conveyance route, a high voltage system drive unit 65 for driving each unit of the developing unit 17 and the transfer roller 43 requiring high voltages, and an exposing drive unit 67 for driving the exposing unit 33. The printer 1 executes a series of printing processes, where the conveyance system drive unit 63, the high voltage system drive unit 65, and the exposing drive unit 67 control each unit under the control of the print engine controller 59.

The power supply operation controller 69 controls the power supply to the heater 49 from the power supply unit 79. The power supply operation controller 69 has a first power supply controller 71 and a second power supply controller 73, and supplies electric power to the heater 49 from the power supply unit 79 upon operation of those controllers 71, 73. The first power supply controller 71 controls power supply from the power supply unit 79 to the heater 49 based on the temperature detection result detected with the temperature detection unit 81. The second power supply controller 73 controls power supply from the power supply unit 79 to the heater 49 based on a prescribed value.

In operation of the printer 1, the controller 55 receiving image information from the personal computer, not shown, through the communication interface 53 supplies an instruction to start the printing process to the print engine controller 59. The print engine controller 59 receiving the instruction supplies an instruction to the conveyance system drive unit 63 to drive the feeding roller 5, thereby feeding the paper P stacked on the stacker 3 toward the medium conveyance route direction. The paper P fed out of the stacker 3 is fed sheet by sheet as separated with the separation frame 7.

When a front end of the paper P fed by the feeding roller 5 reaches the feeding sensor 9, the feeding sensor 9 notifies to the print engine controller 59 through the sensor input unit 75 that the front end of the paper P reaches the feeding sensor 9. The print engine controller 59 receiving the paper detection result feeds an instruction to the conveyance system drive unit 63, thereby driving the conveyance roller 11 and the registration roller 13. The writing sensor 15 as a medium detecting means is disposed on a downstream side of the medium conveyance route of the conveyance roller 11 and the registration roller 13. When the front end of the paper P fed by the conveyance roller 11 and the registration roller 13 reaches the writing sensor 15, the writing sensor 15 notifies to the print engine controller 59 through the sensor input unit 75 that the front end of the paper P reaches the writing sensor 15. The print engine controller 59 receiving the paper detection result feeds an instruction to the high voltage system drive unit 65, thereby driving the developing unit 17 to start a developing process.

When the developing process begins, the charging roller 39 charges the surface of the photosensitive drum 35. The exposing unit 35, along the rotation of the photosensitive drum 35, exposes on the surface of the photosensitive drum 35 electrostatic latent images based on image information input from the personal computer, not shown. Developer is attached by the developing roller 37 to the electrostatic latent images exposed on the photosensitive drum 35, thereby developing the developer images on the photosensitive drum 35. The developer images thus developed on the photosensitive drum 35 are transferred onto the paper P with the transfer roller 43.

The paper P on which the developer images are transferred by the developing unit 17 is conveyed up to the fixing unit 19 provided on a downstream side of the medium conveyance route of the developing unit 17. The developing image transferred onto the paper P is fixed with the fixing unit 17 and fed out in a downstream direction of the medium conveyance route. A delivery sensor 21 is placed on a downstream side of the medium conveyance route. When the front end of the paper P fed out of the fixing unit 19 reaches the delivery sensor 21, the delivery sensor 21 notifies, to the print engine controller 59 through the sensor input unit 75, that the front end of the paper P reaches the delivery sensor 21. The print engine controller 59 receiving the paper detection result provides an instruction to the conveyance system drive unit 63, thereby driving the delivery roller 23 and the registration roller 25. The paper P is conveyed on the downstream side of the medium conveyance route by the delivery roller 23 and the registration roller 25, and is delivered on the stacker 3 formed on a top surface of the printer 1 by the delivery roller 27 and the registration roller 29.

Figure 4:
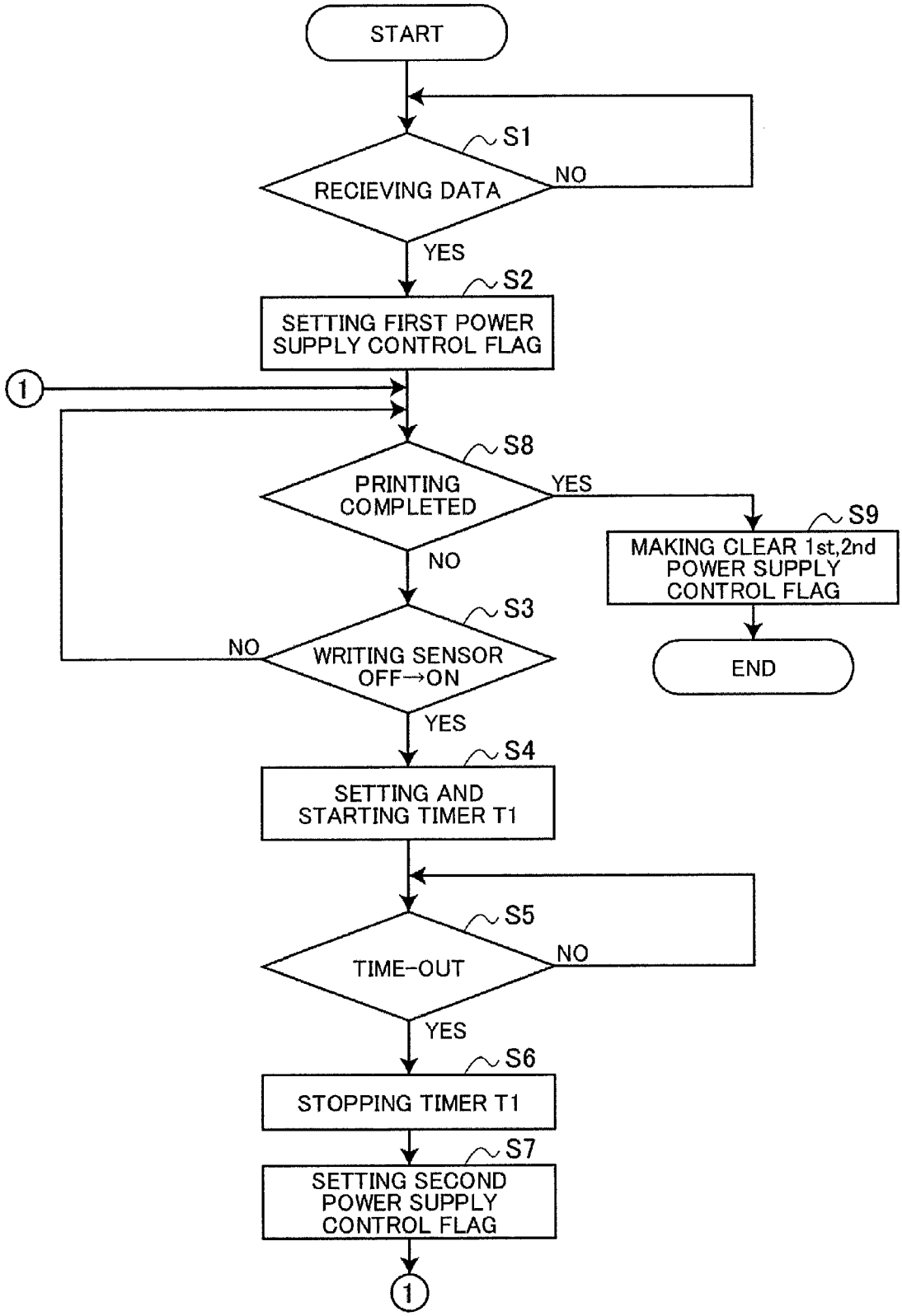
FIG. 4 is a flowchart showing a series of processing steps with respect to power supply control of the printer according to the first embodiment of the invention.
Figure 5:
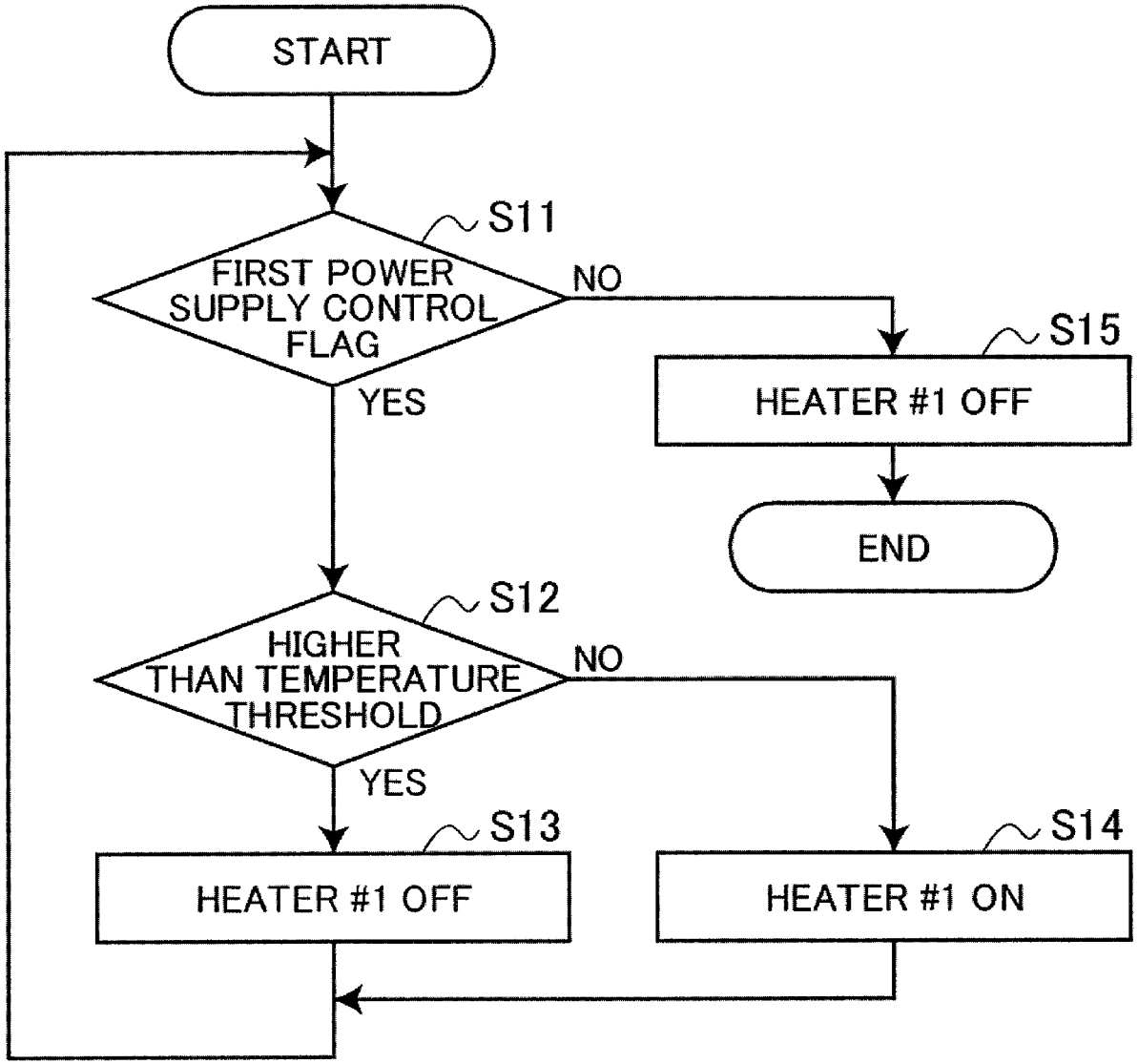
FIG. 5 is a flowchart showing a first power supply control of the printer according to the first embodiment of the invention.
Figure 6:
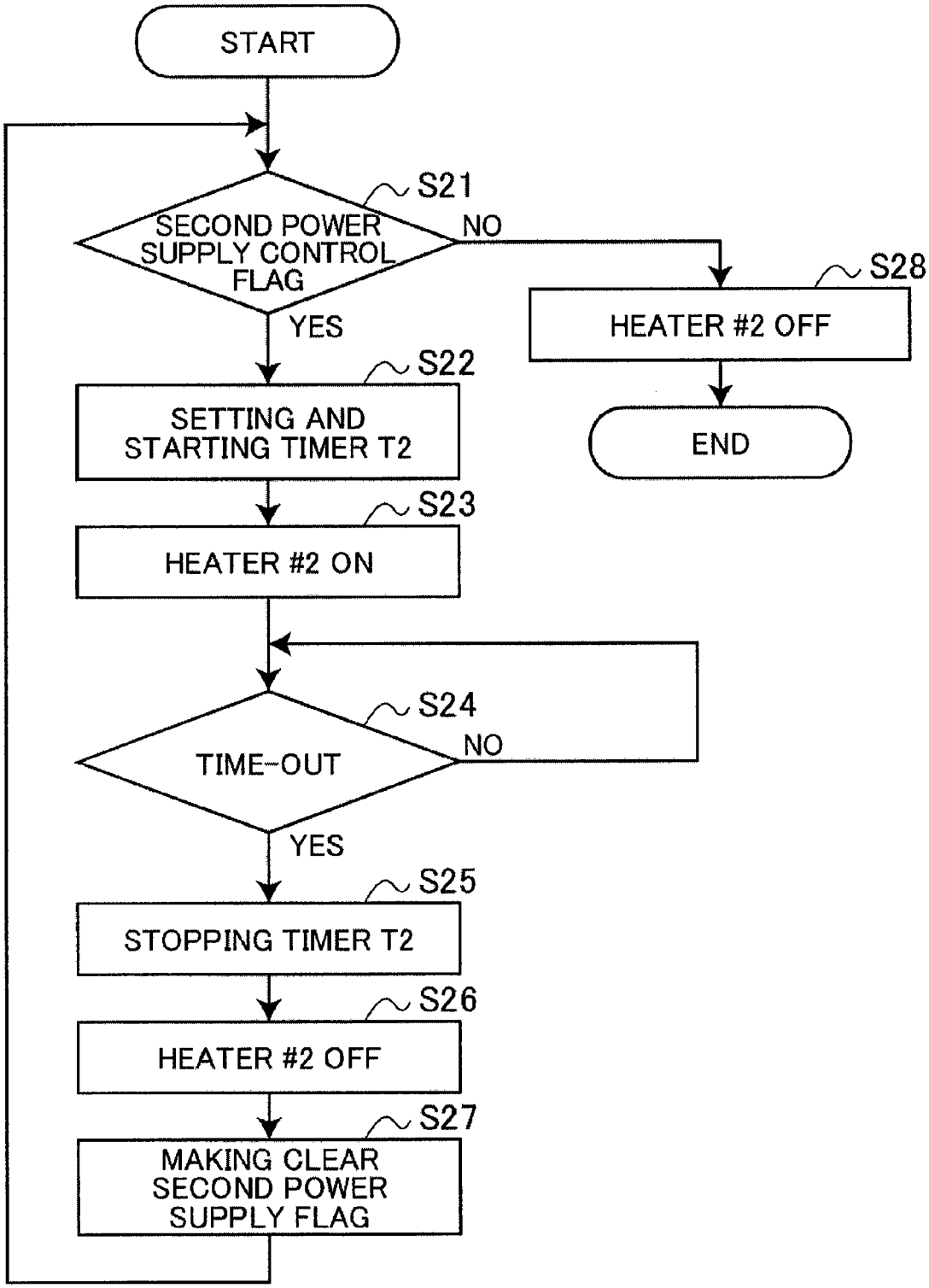
FIG. 6 is a flowchart showing a second power supply control of the printer according to the first embodiment of the invention.

Referring to FIGS. 4, 5, and 6, operation during print processing of the printer 1 is described. FIG. 4 is a flowchart describing a series of processes on power supply control to the printer 1. FIGS. 5, 6 are flowcharts illustrating first power supply control and second power supply control, respectively.

The controller 55 of the printer 1 receives image information from a personal computer through a communication interface 53 (see, FIG. 4, step S1), and instructs to begin the printing process to the print engine controller 59. The print engine controller 59 receiving the instruction of beginning of the printing process instructs the power supply operation controller 69 to set the first power supply control flag. The power supply operation controller 69 upon reception of the instruction sets the first power supply control flag to a predetermined value, such as e.g., one (see, FIG. 4, step S2).

The first power supply control herein means controlling operation done by the first power supply controller 71 for controlling power supplied to the heater 49 from the power supply unit 79 based on the surface temperature of the heater roller 45 detected by the temperature detection unit 81. A start timing of the control by the first power supply controller 71 is, e.g., at a timing of turning on the power of the printer 1 or at a timing of receiving an instruction to start printing from the personal computer, not shown. An ending timing of the control by the first power supply controller 71 is, e.g., at a timing that printing is completed or at a timing that the controller does not receive any instruction to start printing from the personal computer or computers within a prescribed period of time.

In FIG. 5, in a case where the first power supply control flag is set at step S11, the first power supply controller 71 compares the surface temperature of the heat roller 45 input via the temperature detection unit 81 with a prescribed temperature threshold. The first power supply controller 71 makes the heater #1 signal turned on in a case where the current surface temperature of the heat roller 45 is lower than the prescribed temperature threshold, and makes the heater #1 signal turned off in a case where the current surface temperature of the heat roller 45 is higher than the prescribed temperature threshold (see, FIG. 5, steps S12 to S14). To the contrary, in FIG. 5, at step S11, if the first power supply control flag is not set, the first power supply controller 71 turns off the heater #1 signal (see, FIG. 5 step S15).

In FIG. 4, when the front end of the paper P reaches the writing sensor 15 at step S3, the writing sensor 15 notifies, to the print engine controller 59 through the sensor input unit 75, that the front end of the paper P reaches the writing sensor 15. The power supply operation controller 69 detecting that the paper reaches the writing sensor 15 by way of the print engine controller 59 sets a prescribed time T1 to a timer T1 and begins the operation of the timer T1 (see, FIG. 4 step S4). At steps S5 to S7 in FIG. 4, when the timer T1 times out, the power supply controller 69 stops the timer T1, and sets a prescribed value (e.g., one in this embodiment) to the second power supply control flag.

After the second power supply control flag is set, the power supply operation controller 69 makes clear both of the first power supply control flag and the second power supply control flag (see, FIG. 4 step S9) if the printing operation is completed at step S8 in FIG. 4. In a case of continuous printing, detections of reaching of subsequent paper at the writing sensor 15, or namely steps S3 to S7, S8 in FIG. 4, are repeated in step S3 shown in FIG. 4.

The second power supply control herein means that the second power supply controller 73 controls electric power fed to the heater 49 during the prescribed time T2 from the power supply unit 79 regardless the surface temperature of the heat roller 45. In FIG. 6, where the second power supply control flag is set at step S21, the second power supply controller 73 sets a prescribed time T2 to a timer T2 and starts the operation of the time T2 (see, FIG. 6 step S22), and turns on the heater #2 signal (see, FIG. 6 step S23). At steps S24 to S27 in FIG. 6, when the timer T2 times out, the second power supply controller 73 turns off the heater #2 signal and makes clear the second power supply control flag. To the contrary, where the second power supply control flag is not set at step S21 in FIG. 6, the second power supply controller 73 turns off the heater #2 signal as shown at step 28 in FIG. 6.

Figure 7:
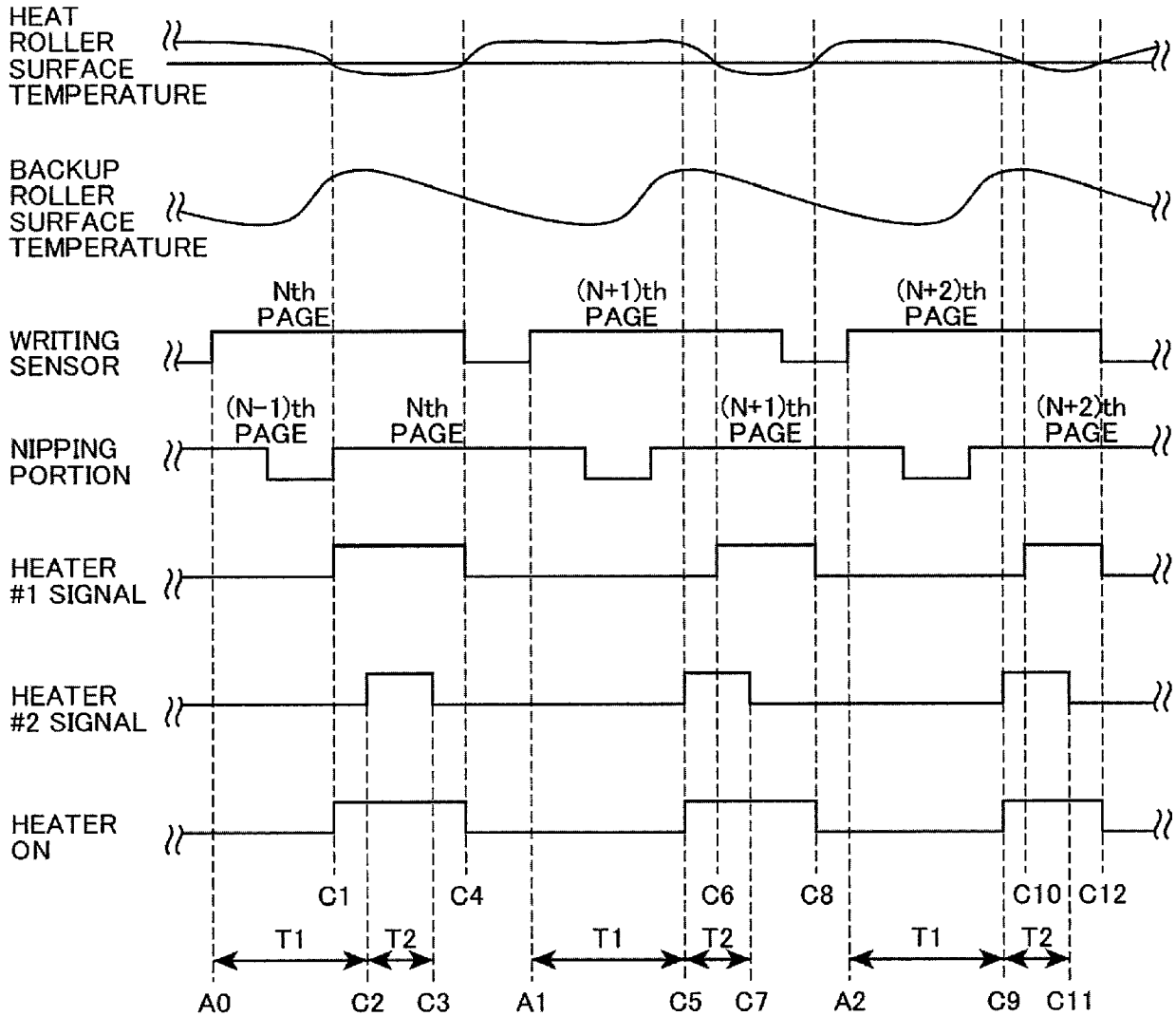
FIG. 7 is a time chart in a case that controlled with a control method according to the first embodiment of the invention.

FIG. 7 illustrates a timing chart describing input timings of heater signals done by the first power supply controller 71 and the second power supply controller 73. In FIG. 7, numerals A0 to A2 indicate timings that the front end of the paper P reaches the writing sensor 15. Numerals C1 to C12 indicate input and stop timings of the heater signals by the first power supply controller 71 and the second power supply controller 73. In this embodiment, the input timings of the heater #1 signal by the first power supply controller 71 are C1, C6, and C10, whereas the stop timings are C4, C8, and C12. Those input and stop timings of the heater #1 signal depend on the surface temperature of the heat roller.

On the other hand, the input timings of the heater #2 signal done by the second power supply controller 73 are C2, C5, C9, whereas the stop timings are C3, C7, and C11. Those input and stop timings of the heater #2 signal depend on the timings at which the writing sensor 15 detects the front end of the Nth, N+1th, and N+2th pages of the paper P.

More specifically, at timing A0, the power supply controller 69 detecting reach of the front end of the Nth page of the paper P sets a prescribed time to the timer T1 and begins the operation of the timer T1. The first power supply controller 71, which judges that the surface temperature of the heat roller 45 is lower than the prescribed temperature threshold upon passing the N−1th page of the paper P by the nipping portion, turns on the heater #1 signal at timing C1. Input of the heater #1 signal renders power supply start from the power supply unit 79 to the heater 49.

The second power supply controller 73 sets the prescribed time to the timer T2 at the same time as the timer T1 times out, and begins the operation of the timer T2, thereby turning on the heater #2 signal at timing C2. When the timer T2 times out, the second power supply controller 73 stops the timer T2 and turns off the heater #2 signal at timing C3. The first power supply controller 71 inputs the heater #1 signal up to timing C4.

Next, at timing A01 the power supply controller 69 detecting reach of the front end of the N+1th page of the paper P by the writing sensor 15 sets a prescribed time to the timer T1 and begins the operation of the timer T1. The first power supply controller 71 does not input the heater #1 signal at that time because the surface temperature of the heat roller 45 is not lowered.

The second power supply controller 73 sets the prescribed time to the timer T2 at the same time as the timer T1 times out, and begins the operation of the timer T2, thereby turning on the heater #2 signal at timing C5. Input of the heater #2 signal renders power supply start from the power supply unit 79 to the heater 49.

The first power supply controller 71, which judges that the surface temperature of the heat roller 45 is lower than the prescribed temperature threshold at timing C6, turns on the heater #1 signal. When the timer T2 times out, the second power supply controller 73 stops the timer T2 and turns off the heater #2 signal at timing C7. Because the surface temperature of the heat roller 45 is lower than the prescribed temperature threshold, the input of the heater #1 signal by the first power supply controller 71 continues until timing C8.

It is to be noted that actual power supply operation is conducted at the power supply operation controller 69, and the power supply unit 79 supplies electric power to the heater 49 where the logical disjunction of the heater turning-on signals of the first power supply controller 71 and the second power supply controller 73, or namely, the logical disjunction of the heater #1 signal and the heater #2 signal results the truth "1", the electric power is supplied from the power supply unit 79 to heater 49. Where the logical disjunction of the heater #1 signal and the heater #2 signal results the false "0", the electric power supplied from the power supply unit 79 to heater 4 is stopped 9.

As described above, regardless input of the heater #1 signal by the first power supply controller 71, the second power supply controller 73 inputs the heater #2 signal for the prescribed time after passing a prescribed time set at the timer T1. The period of time in which the heater 49 receives power supply from the power supply unit 79 is between the timing C1 and the timing C4 for the Nth page of the paper P and is between the timing C5 and the timing C8 for the N+1th page of the paper P.

The timer T1 makes standard the time from detection of paper's front end with the writing sensor 15 and the time of reaching the nipping portion, and the value of T1 is determined based on experimental consequences in consideration of time lag of thermal conductance in the heat roller 45. The value T2 as the output time of the heater #2 signal is so set as to be a time to generally make the heater heated with a half or more and less than one of the heating amount necessary to heat a sheet of the paper.

According to the first embodiment, the image forming apparatus enjoys the first power supply control as a conventional temperature control in accordance with a detected temperature of the heat roller, as well as the second power supply control as a control rendering the heater supplied with power at proper timings and proper periods of time in consideration of the time lag of heater's heat until transfer of the heater's heat to the heat roller surface, so that the image forming apparatus ensures a good settling rate of the developer images to the paper at the second half of the paper.

Second Embodiment

An essential structure of the image forming apparatus according to the second embodiment is substantially the same as that of the image forming apparatus according to the first embodiment. A description is omitted for portions having the same structure as that in the first embodiment with providing the same reference numbers.

In the second embodiment, the timer T1 at which the power supply operation controller 69 sets a prescribed time and the prescribed time T2 during which the second power supply controller 73 turns on the heater #2 signal are as described in the first embodiment. The power supply operation controller 69 according to the second embodiment sets a prescribed time to the timer T1 and at the same time set a prescribed time to a timer T3 to start the operation of the timer T3. A structure in which the second power supply controller 73 does not make the heater #2 signal input where the heater #1 signal is entered by the first power supply controller 71 after the timer T3 times out, is different from those in the first embodiment.

Figure 8:
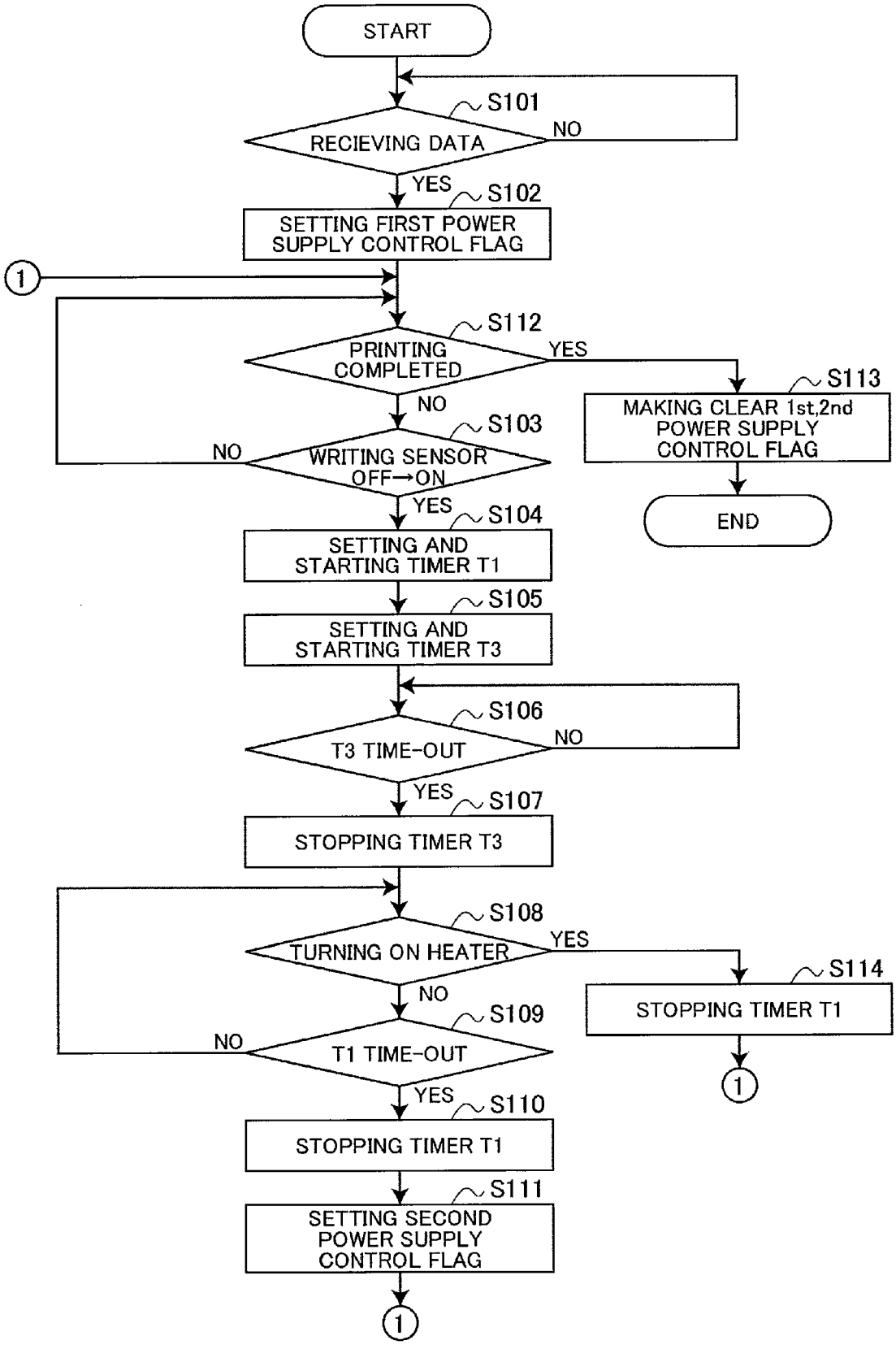
FIG. 8 is a flowchart showing a series of processing steps with respect to power supply control of the printer according to the second embodiment of the invention.

FIG. 8 is a flowchart illustrating a series of processes for power supply control of the printer 1 as an image forming apparatus. It is to be noted that the processes at steps S101 to S103 are substantially the same as those described in the first embodiment. Because the processes at steps S110 to S111 and processes done by the second power supply controller 73 are also substantially the same as those described in the first embodiment, any further description is omitted.

The power supply operation controller 69 sets a prescribed time to the timer T3 and starts the operation of the timer T3 at step S105 after setting the prescribed time T1 to the timer T1 and starting the operation of the timer T1 at step S104 in FIG. 8. The power supply operation controller 69 stops the timer T3 where the timer T3 times out at steps S106, S107 in FIG. 8. The power supply operation controller 69 monitors entry of the heater #1 signal from the first power supply controller 71 until the timer times out at steps S108, S109 in FIG. 8. Where no heater #1 signal is inputted by the first power supply controller 71 and where the timer T1 times out, the power supply operation controller 69 stops the timer T1 at step S110 in FIG. 8 and sets a prescribed value such as, e.g., one in this embodiment to the second power supply control flag.

After the second power supply control flag is set, if printing operation is completed at step S112, the power supply operation controller 69 makes clear both of the first power supply control flag and the second power supply control flag at step S113. In a case of continuing printing, detection of the subsequent paper with the writing sensor 15, or namely steps S103 to S112 are repeated at step S103.

On the other hand, where the first power supply controller 71 enters the heater #1 signal at steps S108, S109 in FIG. 8, or turning on of the heater #1 signal, the power supply operation controller 69 stops the timer T1 at step S114. The power supply operation controller 69 does not set the second power supply control flag and makes clear the first power supply control flag and the second power supply control flag if the printing operation is completed at step S113 in FIG. 8. In a case of continuing printing, detection of the subsequent paper with the writing sensor 15, or namely steps S103 to S112 are repeated at step S103.

Figure 9:
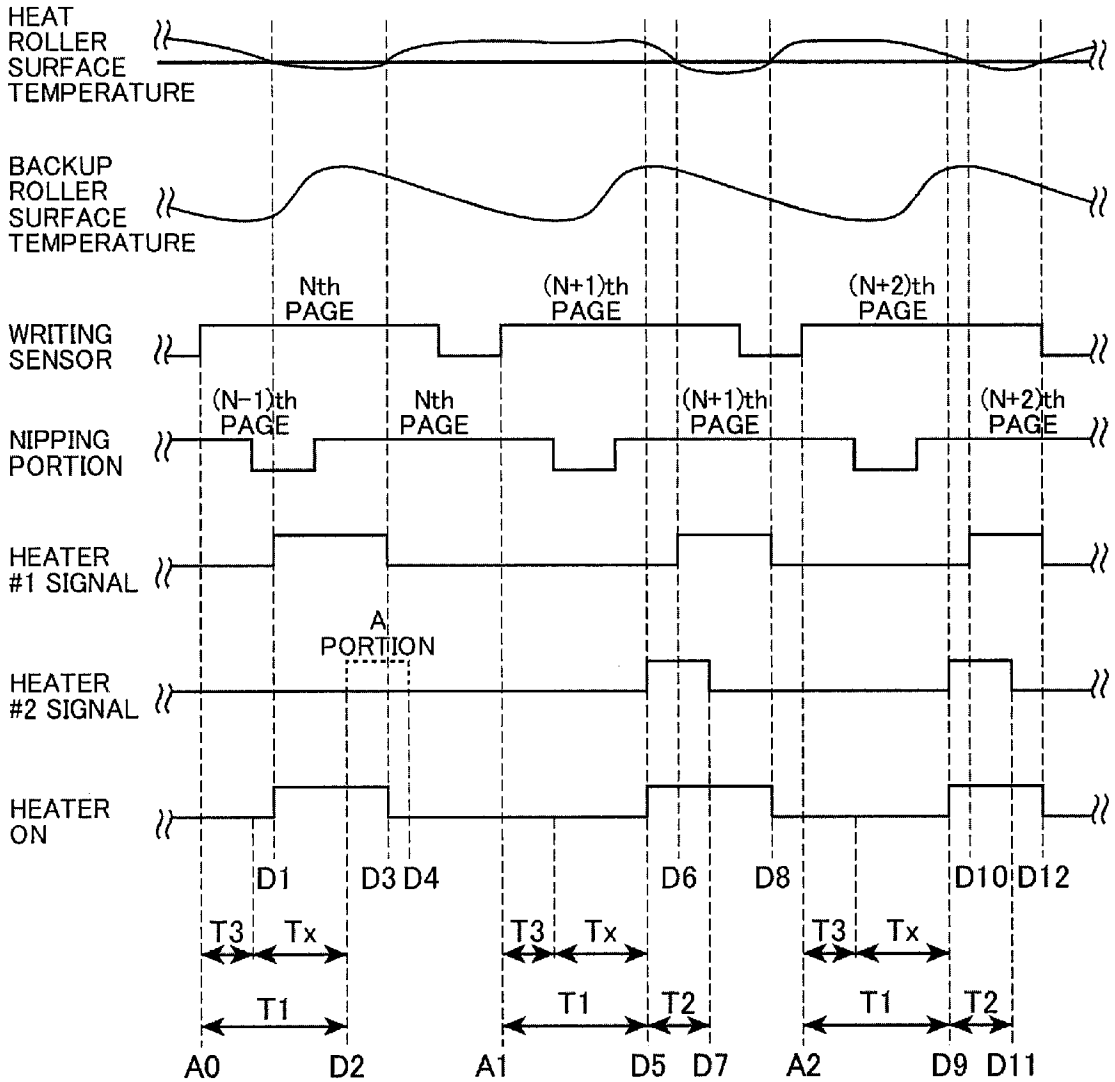
FIG. 9 is a time chart in case that controlled with a control method according to the second embodiment of the invention.

A timing chart of FIG. 9 illustrates timings of inputs of heater signals by the first power supply controller 71 and the second power supply controller 73. Numerals A0, A1, A2, in the same way as those in the timing chart of FIG. 7, indicate timings at which the front end of the paper reaches the writing sensor 15. Numerals D1 to D12 indicate input and stop timings of the heater signals by the first power supply controller 71 and the second power supply controller 73. In this embodiment, the input timings of the heater #1 signal by the first power supply controller 71 are D1, D6, and D10, whereas the stop timings are D3, D8, and D12. Those input and stop timings of the heater #1 signal depend on the surface temperature of the heater roller.

To the contrary, the input timings of the heater #2 signal by the second power supply controller 73 are D2, D5, and D9, whereas the stop timings are D4, D7, and D11. Those input and stop timings of the heater #2 signal depend on timings of writing sensor's detection of front end reaching of the Nth, N+1th, and N+2th pages of the paper P.

More specifically, at timing A0, the power supply controller 69 detecting reach of the front end of the Nth page of the paper P by the writing sensor 15 sets a prescribed time to the timer T1 and begins the operation of the timer T1. The power supply controller 69 at the same time sets a prescribed time to the timer T3 and begins the operation of the timer T3.

The first power supply controller 71, which judges that the surface temperature of the heat roller 45 is lower than the prescribed temperature threshold upon passing the N−1th page of the paper P by the nipping portion, turns on the heater #1 signal at timing D1. Input of the heater #1 signal renders power supply start from the power supply unit 79 to the heater 49.

The power supply controller 69, at the same time as the timer T3 times out, monitors as to whether the first power supply controller 71 inputs the heater #1 signal until that the timer T1 times out (period Tx). Although the second power supply controller 73 normally sets the prescribed time to the timer T2 at the same time as the timer T1 times out (timing D2) and begins the operation of the timer T2 to turn on the heater #2 signal at timing C2, the second power supply controller 73 does not input the heater #2 signal during the period Tx (A portion in FIG. 9) because the first power supply controller 71 inputs the heater #1 signal. To the contrary, first power supply controller 71 inputs the heater #1 signal until timing D3.

Next, at timing A01 the power supply controller 69 detecting reach of the front end of the N+1th page of the paper P by the writing sensor 15 sets a prescribed time to the timer T1 and begins the operation of the timer T1. The power supply controller 69 at the same time sets a prescribed time to the timer T3 and begins the operation of the timer T3. The first power supply controller 71 does not input the heater #1 signal at that time because the surface temperature of the heat roller 45 is not lowered.

The power supply controller 69, at the same time as the timer T3 times out, monitors as to whether the first power supply controller 71 inputs the heater #1 signal until that the timer T1 times out (period Tx). Because the first power supply controller 71 does not input the heater #1 signal during period Tx, the second power supply controller 73 sets the prescribed time to the timer T2 at the same time as the timer T1 times out, and begins the operation of the timer T2, thereby turning on the heater #2 signal at timing D5. Input of the heater #2 signal renders power supply start from the power supply unit 79 to the heater 49.

The first power supply controller 71, which judges that the surface temperature of the heat roller 45 is lower than the prescribed temperature threshold at timing D6, turns on the heater #1 signal. When the timer T2 times out, the second power supply controller 73 stops the timer T2 and turns off the heater #2 signal at timing D7. Because the surface temperature of the heat roller 45 is lower than the prescribed temperature threshold, the input of the heater #1 signal by the first power supply controller 71 continues until timing D8.

It is to be noted that actual power supply operation is conducted at the power supply operation controller 69, and the power supply unit 79 supplies electric power to the heater 49 where the logical disjunction of the heater turning-on signals of the first power supply controller 71 and the second power supply controller 73, or namely, the logical disjunction of the heater #1 signal and the heater #2 signal results the truth "1", the electric power is supplied from the power supply unit 79 to heater 49. Where the logical disjunction of the heater #1 signal and the heater #2 signal results the false "0", the electric power supplied from the power supply unit 79 to heater 4 is stopped 9.

As described above, input of the heater #2 signal by the second power supply controller 73 is controlled by input of the heater #1 signal by the first power supply controller 71. To the contrary, the input of the heater #1 signal of the first power supply controller 71 is not controlled by input of the heater #2 signal by the second power supply controller 73. The period of time in which the heater 49 actually receives power supply from the power supply unit 79 is between the timing D1 and the timing D3 for the Nth page of the paper P and is between the timing D5 and the timing D8 for the N+1th page of the paper P.

It is to be noted that the setting value of the timer T3 is a time rendering Tx to be a half or more and less than one of T2, and is calculated from a formula T3=T1−Tx.

According to the second embodiment, the image forming apparatus enjoys the advantages in association with the first embodiment, and also reduces temperature ripples occurring due to excessive supply of heat, thereby ensuring good settling, because the second power supply control is not performed in a case where the heater #1 signal is "1" immediately before execution of the second power supply control, or namely where the heater #1 signal is tuned on.

Third Embodiment

An essential structure of the image forming apparatus according to the third embodiment is substantially the same as that of the image forming apparatus according to the second embodiment. A description is omitted for portions having the same structure as that in the above embodiments with providing the same reference numbers.

In the third embodiment, the timers T1, T3 at which the power supply operation controller 69 sets a prescribed time and the prescribed time T2 during which the second power supply controller 73 turns on the heater #2 signal are as described in the second embodiment. The controlling method of the surface temperature of the heat roller according to the third embodiment is different from the controlling method according to the first, second embodiments at a point that a prescribed time to be set to the timers is changed according to the paper thickness and the paper size.

Figure 10:
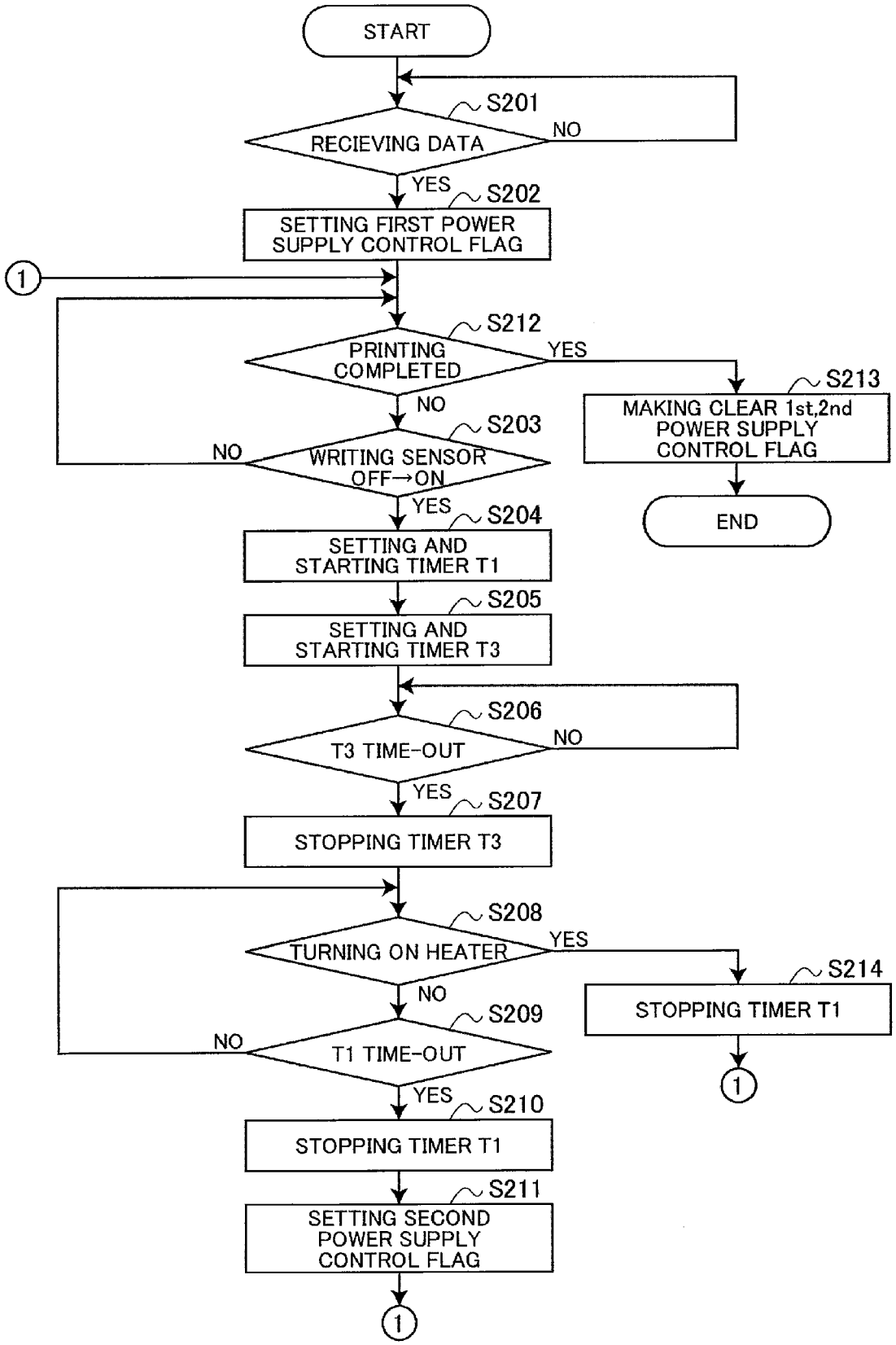
FIG. 10 is a flowchart showing a series of processing steps with respect to power supply control of the printer according to the third embodiment of the invention.
Figure 11:
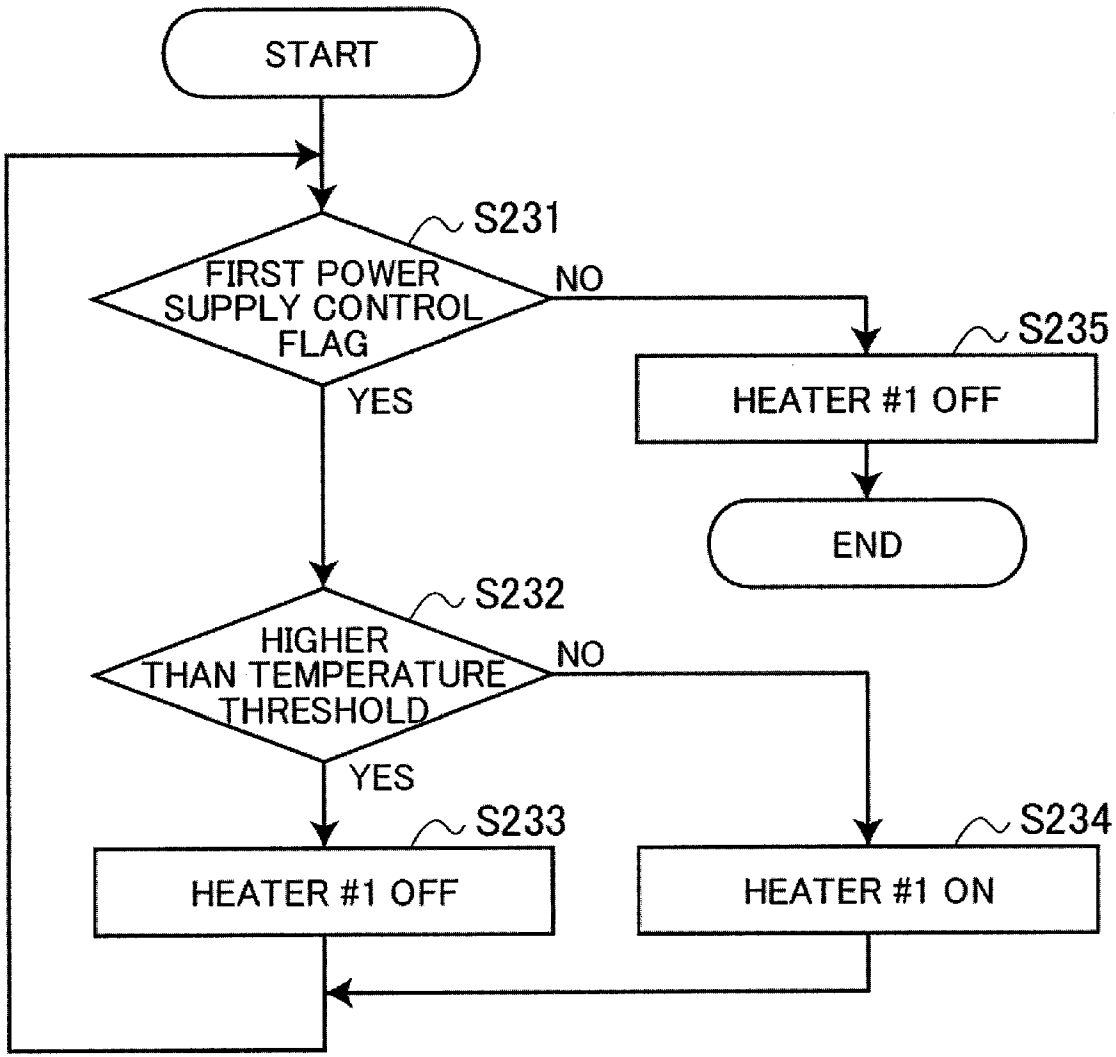
FIG. 11 is a flowchart showing a first power supply control of the printer according to the third embodiment of the invention.
Figure 12:
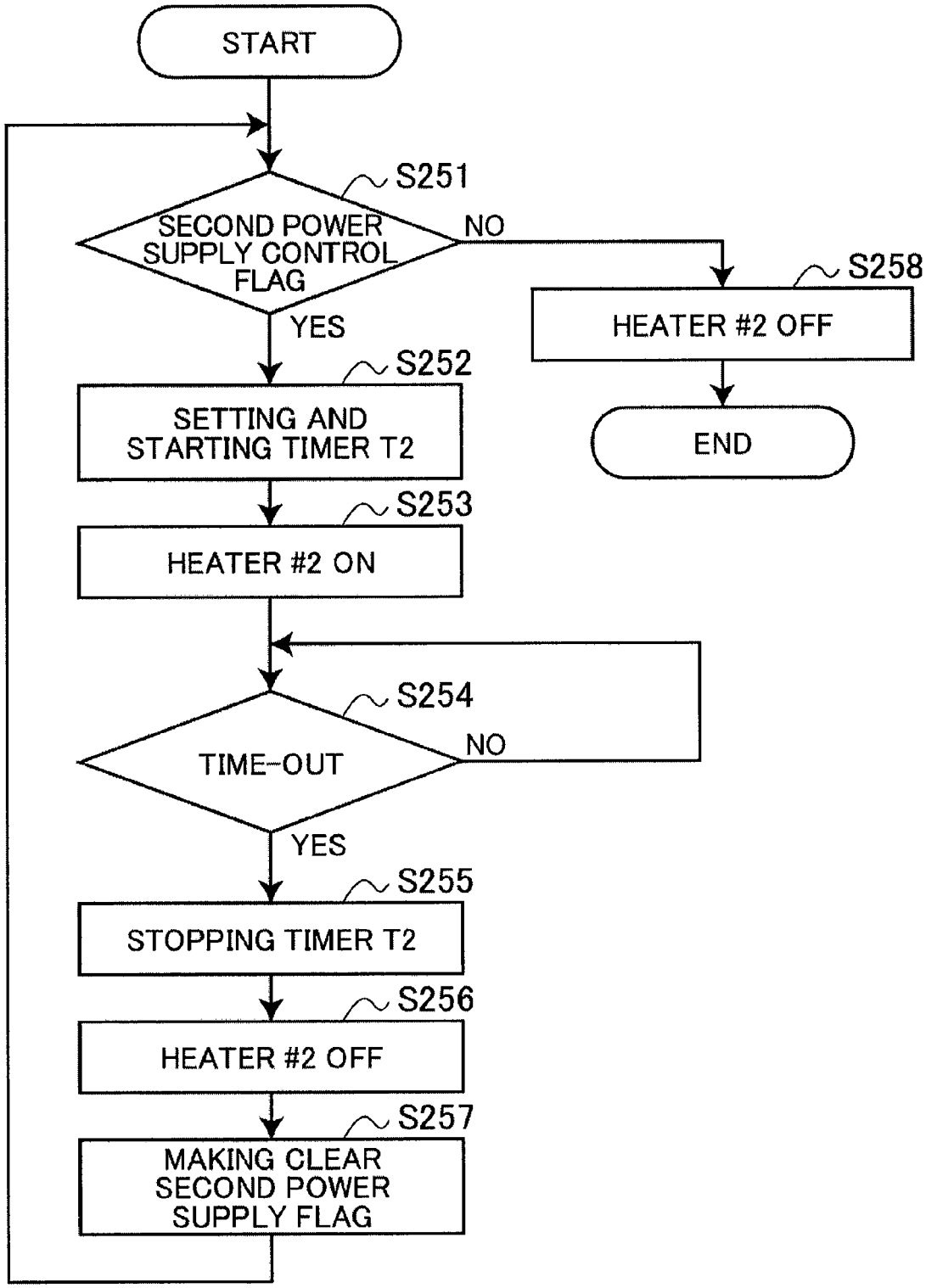
FIG. 12 is a flowchart showing a second power supply control of the printer according to the third embodiment of the invention.

FIG. 10 is a flowchart for describing a series of processes of the power supply control of the printer 1 serving as an image forming apparatus. FIG. 11 and FIG. 12 are flowcharts for describing the first power supply control and the second power supply control.

The controller 55 of the printer 1 receives image information from a personal computer through a communication interface 53 (see, FIG. 10, step S201), and instructs to begin the printing process to the print engine controller 59. The print engine controller 59 receiving the instruction of beginning of the printing process instructs the power supply operation controller 69 to set the first power supply control flag. The power supply operation controller 69 upon reception of the instruction sets the first power supply control flag to a predetermined value, such as e.g., one (see, FIG. 10, step S202).

In FIG. 11, in a case where the first power supply control flag is set at step S231, the first power supply controller 71 compares the surface temperature of the heat roller 45 input via the temperature detection unit 81 with a prescribed temperature threshold. The first power supply controller 71 makes the heater #1 signal turned on in a case where the current surface temperature of the heat roller 45 is lower than the prescribed temperature threshold, and makes the heater #1 signal turned off in a case where the current surface temperature of the heat roller 45 is higher than the prescribed temperature threshold (see, FIG. 11, steps S232 to S234). To the contrary, in FIG. 11, at step 231, if the first power supply control flag is not set, the first power supply controller 71 turns off the heater #1 signal (see, FIG. 11 step S235).

In FIG. 10, when the front end of the paper P reaches the writing sensor 15 at step S203, the writing sensor 15 notifies, to the print engine controller 59 through the sensor input unit 75, that the front end of the paper P reaches the writing sensor 15. The power supply operation controller 69 detecting that the paper reaches the writing sensor 15 by way of the print engine controller 59 sets a prescribed time T1 to a timer T1 in reference with a parameter table based on information on thickness and size of the paper P and begins the operation of the timer T1 (see, FIG. 10 step S204). The power supply operation controller 69 also sets a prescribed time to the timer T3 and begins the operation of the timer T3 (see, FIG. 10 step S205). At steps S206, S207 in FIG. 10, when the timer T3 times out, the power supply controller 69 stops the timer T3. After the timer T3 is stopped, the power supply operation controller 69 monitors entry of the heater #1 signal from the first power supply controller 71 until the timer T1 times out at steps S208, S209 in FIG. 10. Where no heater #1 signal is inputted by the first power supply controller 71 and where the timer T1 times out, the power supply operation controller 69 stops the timer T1 at step S210 in FIG. 10 and sets a prescribed value such as, e.g., one in this embodiment to the second power supply control flag.

After the second power supply control flag is set, the power supply operation controller 69 makes clear both of the first power supply control flag and the second power supply control flag (see, FIG. 10 step S213) if the printing operation is completed at step S212 in FIG. 10. In a case of continuous printing, detections of reaching of subsequent paper at the writing sensor 15, or namely steps S203 to S211, S212 in FIG. 10, are repeated in step S203 shown in FIG. 10.

In a meantime, where the first power supply controller 71 inputs the heater #1 signal at steps S208, S209 in FIG. 10 (heater #1 signal turned on), the power supply operation controller 69 stops the timer T1 at step S214 in FIG. 10. The power supply operation controller 69 does not set the second power supply control flag, and makes clear both of the first power supply control flag and the second power supply control flag (see, FIG. 10 step S213) if the printing operation is completed at step S212 in FIG. 10. In a case of continuous printing, detections of reaching of subsequent paper at the writing sensor 15, or namely steps S203 to S211, S212 in FIG. 10, are repeated in step S203 shown in FIG. 10 as described above.

In this operation, where the second power supply control flag is set at S251 in FIG. 12, the second power supply controller 73 sets a prescribed time T2 to the timer T2 in reference with the parameter table based on information on thickness and size of the paper P and begins the operation of the timer T2 (step S252 in FIG. 12), thereby turning on the heater #2 signal (step S253 in FIG. 12). Where the timer T2 times out at steps S254 to S257 in FIG. 12, the second power supply controller 73 stops the timer T2. The second power supply controller 73 subsequently turns off the heater #2 signal and makes clear the second power supply control flag. On the other hand, where the second power supply control flag is not set at step S251 in FIG. 12, the second power supply controller 73 turns off the heater #2 signal (step S258 in FIG. 12).

Table 1 shows an example of the parameter table based on information on thickness and size of the paper P according to this embodiment. Numeral T1 serving as turning-on time of the heater #1 signal by the first power supply controller 71 is set to have a longer time for paper having a longer paper size, and numeral T2 serving as turning-on time of the heater #2 signal by the second power supply controller 73 is set to have a longer time for paper having a thicker paper thickness than that having a thinner paper thickness, because the paper having a thicker thickness has a much more heating amount taken by the paper.

TABLE 1

| | Size | | | | | |
|---|---|---|---|---|---|---|
| | Letter | | | Legal | | |
| | Thickness | | | | | |
| | thin | middle | thick | thin | middle | thick |
| T1 | T1a | T1a | T1a | T1b | T1b | T1b |
| T2 | T2a | T2b | T2c | T2d | T2e | T2f |

wherein T1 and T2 satisfy following relations: T1*a*<T1*b*
T2*a*<T2*b*<T2*c*, T2*d*<T2*e*<T2*f*
T2*a*<T2*d*, T2*b*<T2*e*, T2*c*<T2*f*

As described above, according to the third embodiment, the image forming apparatus enjoys the advantages in association with the first and second embodiments, and also ensure an appropriate settling feature even where paper having different size or thickness is used because the turning-on time of the heater #1 signal by the first power supply control is set longer as the paper size is longer and because the turning-on time of the heater #2 signal by the second power supply control is set longer as the paper thickness is thicker.

Fourth Embodiment

An essential structure of the image forming apparatus according to the fourth embodiment is substantially the same as that of the image forming apparatus according to the third embodiment. A description is omitted for portions having the same structure as that in the above embodiments with providing the same reference numbers.

In the third embodiment, the timers T1, T3 to which the power supply operation controller 69 sets a prescribed time and the prescribed time T2 during which the second power supply controller 73 turns on the heater #2 signal are as described in the third embodiment.

A method for controlling the surface temperature of the fixing roller of the image forming apparatus according to the fourth embodiment is different from the first to third embodiments in a point switching between the control by the first power supply controller and the control by the second power supply controller and executing selectively only one of the controls at a prescribed timing.

Figure 13:
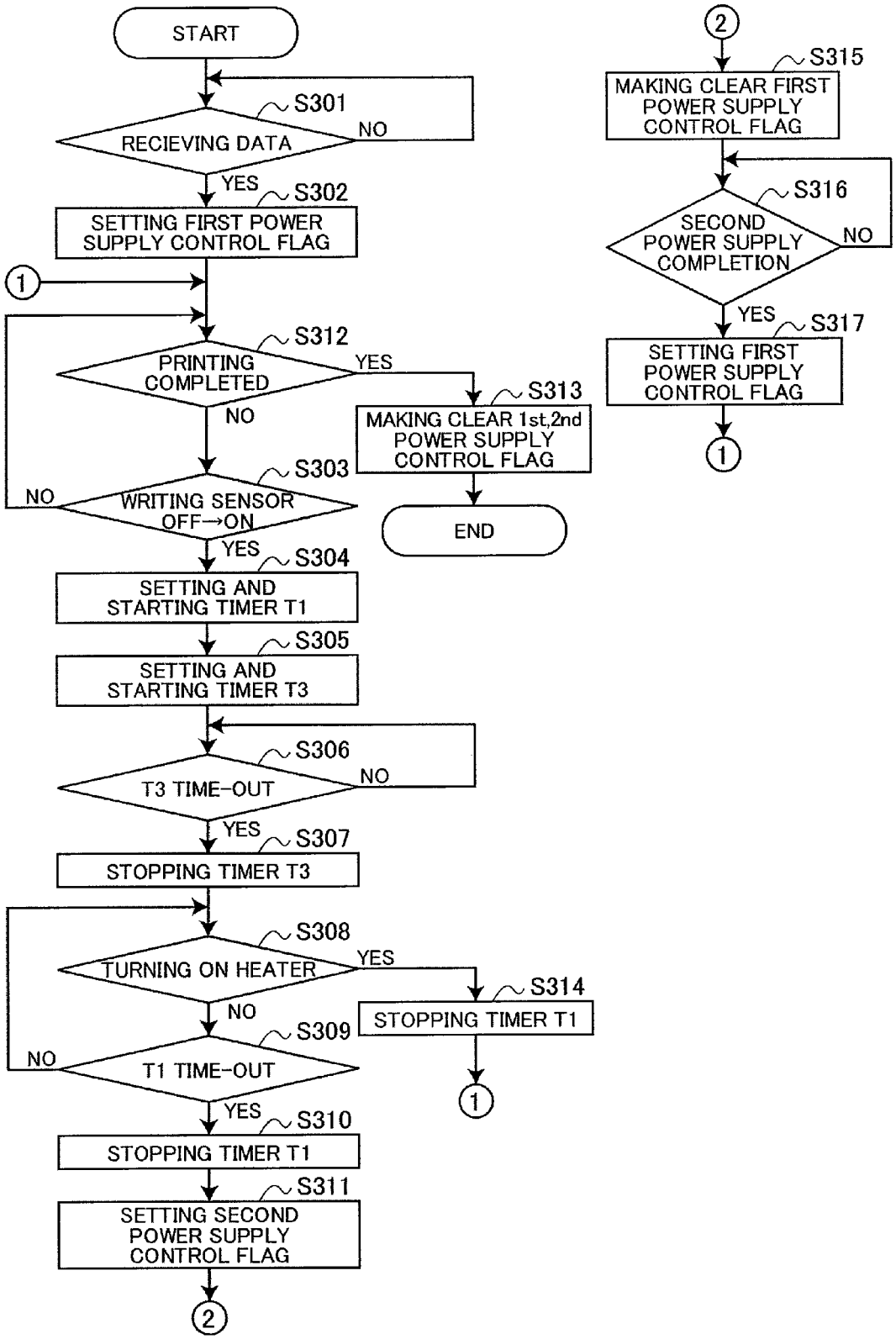
FIG. 13 is a flowchart showing a series of processing steps with respect to power supply control of the printer according to the fourth embodiment of the invention.
Figure 14:
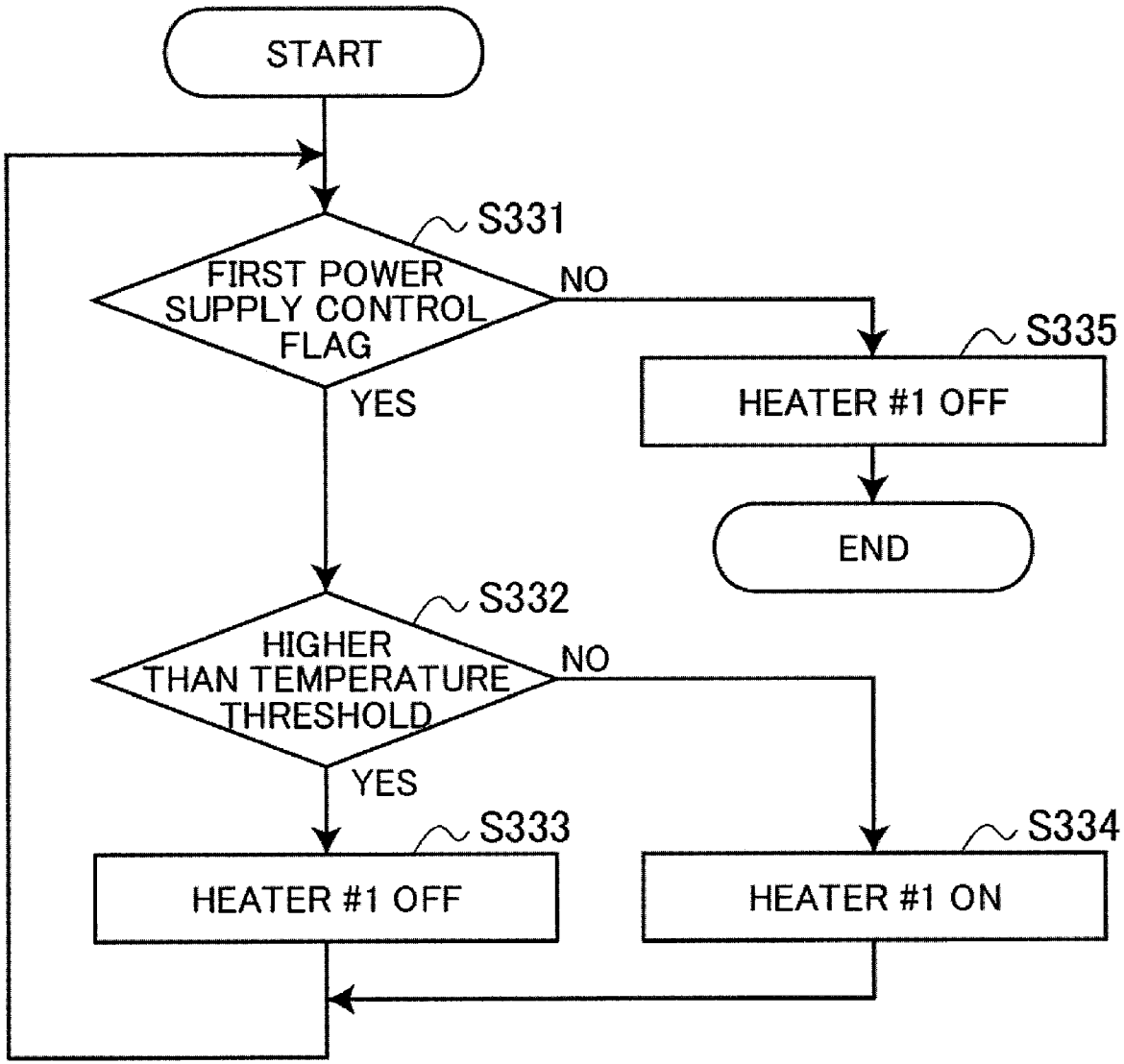
FIG. 14 is a flowchart showing a first power supply control of the printer according to the fourth embodiment of the invention.
Figure 15:
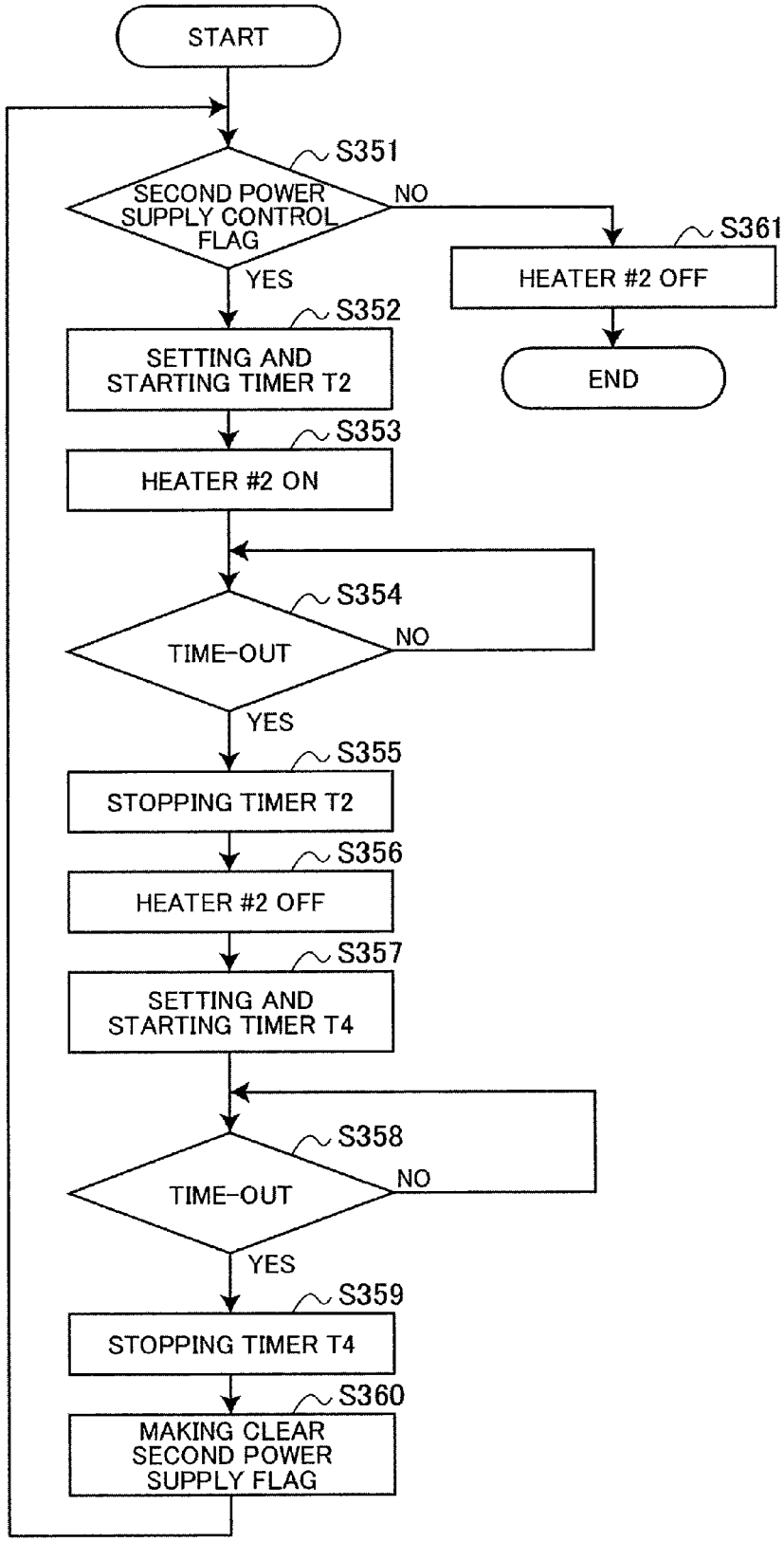
FIG. 15 is a flowchart showing a second power supply control of the printer according to the fourth embodiment of the invention.

FIG. 13 is a flowchart illustrating a series of processes for power supply control of the printer 1 as an image forming apparatus. FIG. 14 and FIG. 15 are flowcharts illustrating the first power supply control and the second power supply control, respectively.

The controller 55 of the printer 1 receives image information from a personal computer through a communication interface 53 (see, FIG. 14, step S301), and instructs to begin the printing process to the print engine controller 59. The print engine controller 59 receiving the instruction of beginning of the printing process instructs the power supply operation controller 69 to set the first power supply control flag. The power supply operation controller 69 upon reception of the instruction sets the first power supply control flag to a predetermined value, such as e.g., one (see, FIG. 14, step S302).

In FIG. 15, in a case where the first power supply control flag is set at step S331, the first power supply controller 71 compares the surface temperature of the heat roller 45 input via the temperature detection unit 81 with a prescribed temperature threshold. The first power supply controller 71 makes the heater #1 signal turned on in a case where the current surface temperature of the heat roller 45 is lower than the prescribed temperature threshold, and makes the heater #1 signal turned off in a case where the current surface temperature of the heat roller 45 is higher than the prescribed temperature threshold (see, FIG. 15, steps S332 to S334). To the contrary, in FIG. 15, at step 331, if the first power supply control flag is not set, the first power supply controller 71 turns off the heater #1 signal (see, FIG. 15 step S335).

In FIG. 14, when the front end of the paper P reaches the writing sensor 15 at step S303, the writing sensor 15 notifies, to the print control unit 59 through the sensor input unit 75, that the front end of the paper P reaches the writing sensor 15. The power supply operation controller 69 detecting that the paper reaches the writing sensor 15 by way of the print engine controller 59 sets a prescribed time T1 to a timer T1 in reference with a parameter table based on information on thickness and size of the paper P and begins the operation of the timer T1 (see, FIG. 14 step S304). The power supply operation controller 69 also sets a prescribed time to the timer T3 and begins the operation of the timer T3 (see, FIG. 14 step S305). At steps S306, S307 in FIG. 14, when the timer T3 times out, the power supply controller 69 stops the timer T3. After the timer T3 is stopped, the power supply operation controller 69 monitors entry of the heater #1 signal from the first power supply controller 71 until the timer T1 times out at steps S308, S309 in FIG. 14. Where no heater #1 signal is inputted by the first power supply controller 71 and where the timer T1 times out, the power supply operation controller 69 stops the timer T1 at step S310 in FIG. 14, sets a prescribed value such as, e.g., one in this embodiment to the second power supply control flag at step S311 in FIG. 14, and makes clear the first power supply control flag at step S315 in FIG. 14. The first power supply controller 71 turns off the heater #1 signal upon clearance of the first power supply control flag.

The power supply operation controller 69 waits for the end of the second power supply control at step S316 in FIG. 14, and sets the first power supply control flag at step S317 in FIG. 14 when the second power supply control is completed. After the first power supply control flag is set, the power supply operation controller 69 makes clear both of the first power supply control flag and the second power supply control flag (see, FIG. 14 step S313) if the printing operation is completed at step S312 in FIG. 14. In a case of continuous printing, detections of reaching of subsequent paper at the writing sensor 15, or namely steps S303 to S311, S312 in FIG. 14, are repeated in step S303 shown in FIG. 14.

In a meantime, where the first power supply controller 71 inputs the heater #1 signal at steps S308, S309 in FIG. 14 (heater #1 signal turned on), the power supply operation controller 69 stops the timer T1 at step S314 in FIG. 14. At that time, the power supply operation controller 69 does not set the second power supply control flag, and makes clear both of the first power supply control flag and the second power supply control flag (see, FIG. 14 step S313) if the printing operation is completed at step S312 in FIG. 14. In a case of continuous printing, detections of reaching of subsequent paper at the writing sensor 15, or namely steps S303 to S311, S312 in FIG. 14, are repeated in step S303 shown in FIG. 14 as described above.

Figure 16:
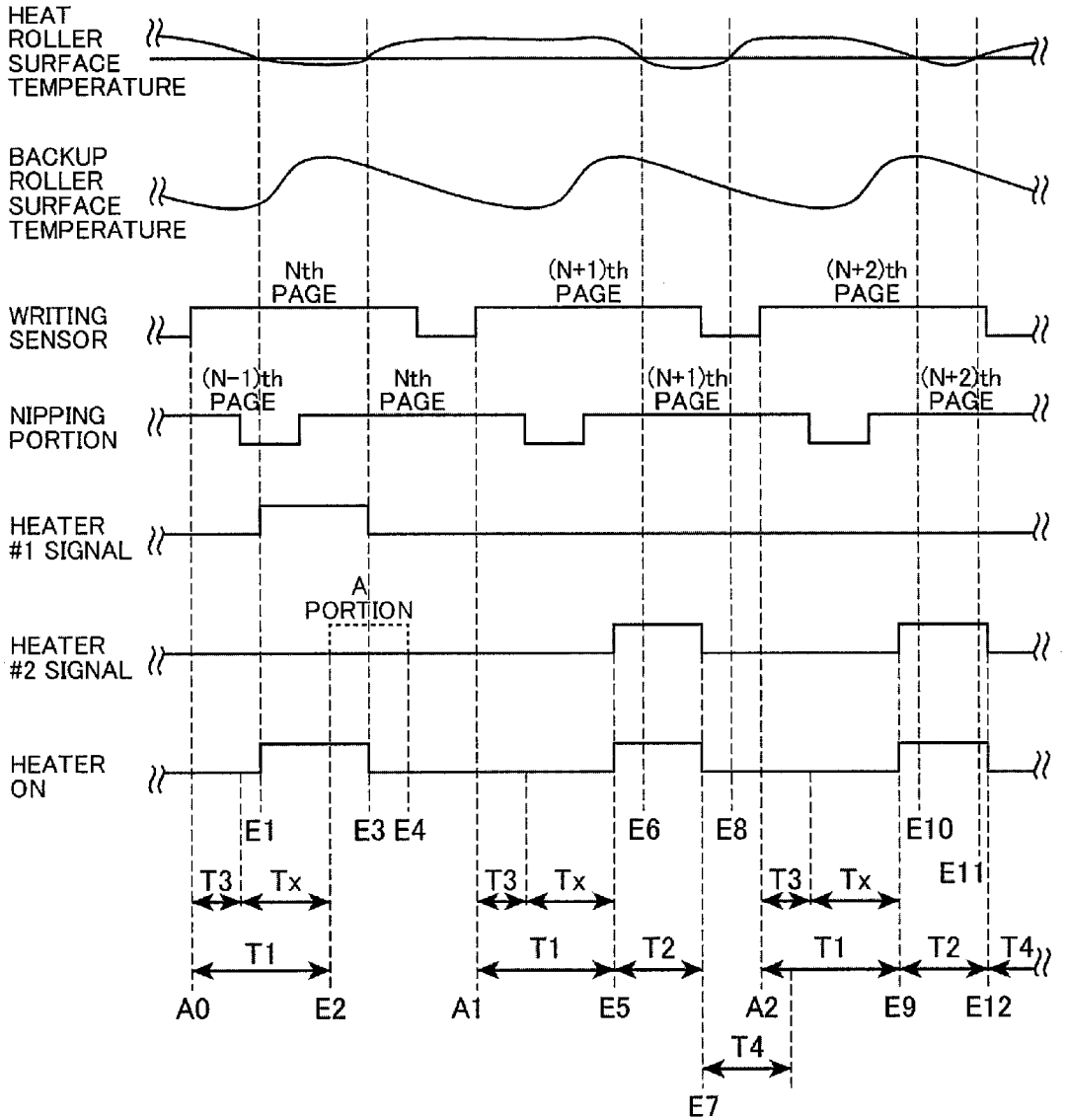
FIG. 16 is a time chart in a case that controlled with a control method according to the fourth embodiment of the invention.
Figure 17:
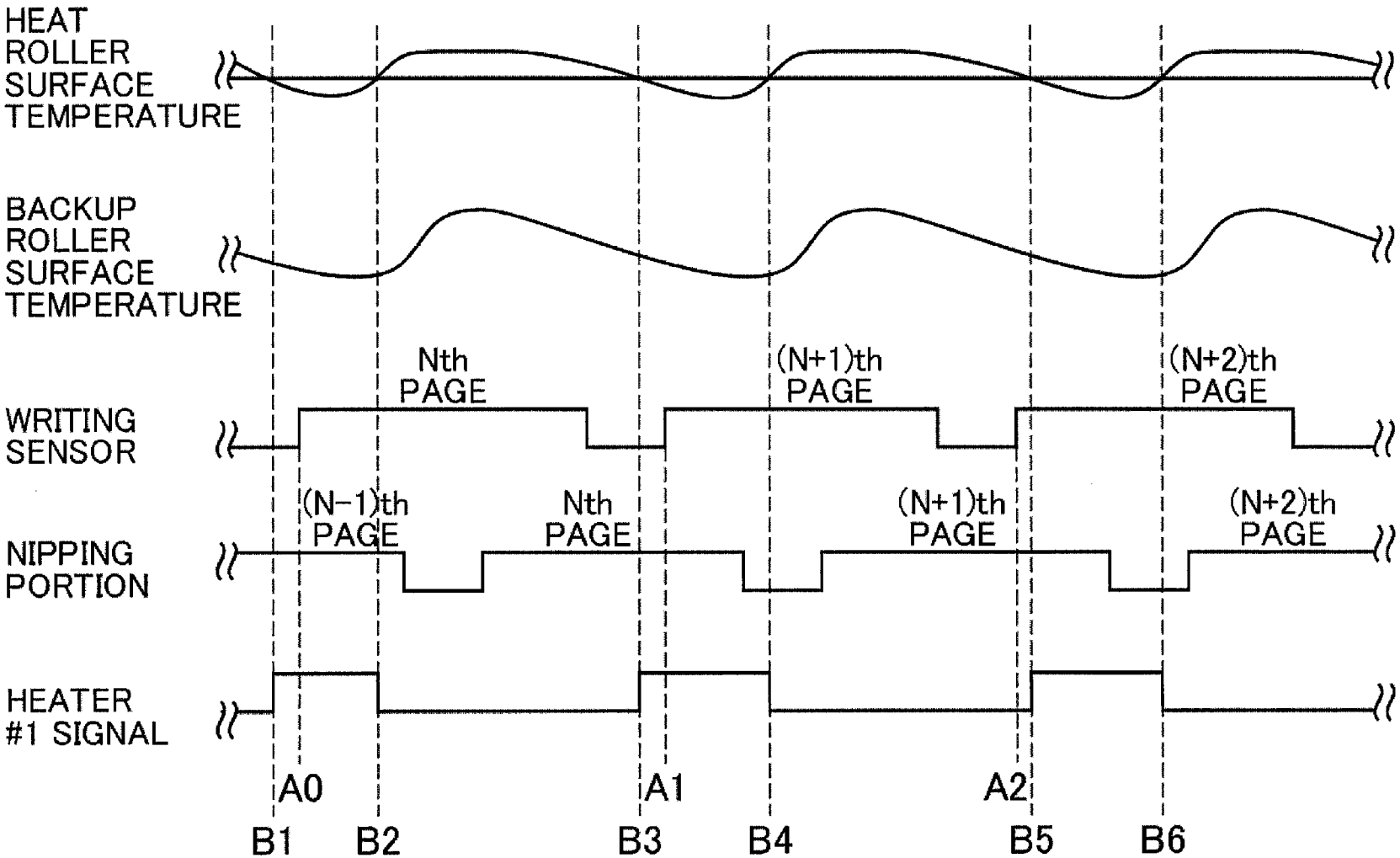
FIG. 17 is a time chart in a case that controlled only with a conventional power supply control.

In this operation, where the second power supply control flag is set at S351 in FIG. 16, the second power supply controller 73 sets a prescribed time T2 to the timer T2 in reference with the parameter table based on information on thickness and size of the paper P and begins the operation of the timer T2 (step S352 in FIG. 16), thereby turning on the heater #2 signal (step S353 in FIG. 16). Where the timer T2 times out at steps S354 to S357 in FIG. 16, the second power supply controller 73 stops the timer T2 and turns off the heater #2 signal. The second power supply controller 73 stops the timer T4 and makes clear the second power supply control flag. On the other hand, where the second power supply control flag is not set at step S351 in FIG. 16, the second power supply controller 73 turns off the heater #2 signal (step S361 in FIG. 16).

A timing chart in FIG. 16 illustrates input timings of the heater signals by the first power supply controller 71 and the second power supply controller 73. Numerals A0, A1, and A2 in FIG. 16 indicate timings at which the front end of the paper P reaches the writing sensor 15 in substantially the same way as described in FIGS. 7, 9. Numerals E1 to E12 indicate input and stop timings of the heater signals by the first power supply controller 71 and the second power supply controller 73. In this embodiment, the input timings of the heater #1 signal by the first power supply controller 71 are E1, E6, and E10, whereas the stop timings are E3, E8, and E11. The input and stop timings of the heater #1 signal depend on the surface temperature of the heat roller. Meanwhile, the input timings of the heater #2 signal by the second power supply controller 73 are E2, E5, and E9, whereas the stop timings are E4, E7, and E12. The input and stop timings of the heater #2 signal depend on timings at which the writing sensor 15 detects the front end of the Nth, N+1th, and N+2th page of the paper P.

More specifically, at timing A0, the power supply controller 69 detecting reach of the front end of the Nth page of the paper P by the writing sensor 15 sets a prescribed time to the timer T1 and begins the operation of the timer T1. The power supply controller 69 at the same time sets a prescribed time to the timer T3 and begins the operation of the timer T3.

The first power supply controller 71, which judges that the surface temperature of the heat roller 45 is lower than the prescribed temperature threshold upon passing the N−1th page of the paper P by the nipping portion, turns on the heater #1 signal at timing E1. Input of the heater #1 signal renders power supply start from the power supply unit 79 to the heater 49.

The power supply controller 69, at the same time as the timer T3 times out, monitors as to whether the first power supply controller 71 inputs the heater #1 signal until that the timer T1 times out (period Tx). Although the second power supply controller 73 normally sets the prescribed time to the timer T2 at the same time as the timer T1 times out (timing E2) and begins the operation of the timer T2 to turn on the heater #2 signal at timing C2, the second power supply controller 73 does not input the heater #2 signal during the period Tx (A portion in FIG. 16) because the first power supply controller 71 inputs the heater #1 signal. To the contrary, first power supply controller 71 inputs the heater #1 signal until timing E3.

Next, at timing A01 the power supply controller 69 detecting reach of the front end of the N+1th page of the paper P by the writing sensor 15 sets a prescribed time to the timer T1 and begins the operation of the timer T1. The power supply controller 69 at the same time sets a prescribed time to the timer T3 and begins the operation of the timer T3. The first power supply controller 71 does not input the heater #1 signal at that time because the surface temperature of the heat roller 45 is not lowered.

The power supply controller 69, at the same time as the timer T3 times out, monitors as to whether the first power supply controller 71 inputs the heater #1 signal until that the timer T1 times out (period Tx). Because the first power supply controller 71 does not input the heater #1 signal during period Tx, the second power supply controller 73 sets the prescribed time to the timer T2 at the same time as the timer T1 times out, and begins the operation of the timer T2, thereby turning on the heater #2 signal at timing E5. Input of the heater #2 signal renders power supply start from the power supply unit 79 to the heater 49.

Although the first power supply controller 71, which judges that the surface temperature of the heat roller 45 is lower than the prescribed temperature threshold at timing E6, normally turns on the heater #1 signal, the first power supply controller 71 does not turn on the heater #1 signal because the second power supply controller 73 does not complete the power supply control. When the timer T2 times out, the second power supply controller 73 stops the timer T2 and turns off the heater #2 signal at timing E7. The second power supply controller 73 at the same time sets a prescribed time to the timer T4 and begins the operation of the timer T4. When the timer T4 times out, the second power supply controller 73 stops the timer T4, and the power supply control by the second power supply controller 73 is completed.

As described above, the input of the heater #2 signal by the second power supply controller 73 is controlled by the input of the heater #1 signal by the first power supply controller 71. In a meantime, the input of the heater #1 signal by the first power supply controller 71 is also controlled by the input of the heater #2 signal by the second power supply controller 73. Accordingly, the time during which the heater 49 is supplied with electric power from the power supply unit 79 is a period between E1 to E3 for the Nth page of the paper P, and is a period between E5 and E7 for the N+1th page of the paper P.

It is to be noted that the timer T4 operates for a time continuing stop of the heater #2 signal by the second power supply controller 73, which is necessary time for preventing excessive heating supply by the first power supply controller 71.

As described above, according to the fourth embodiment, the image forming apparatus reduces temperature ripples occurring due to excessive supply of heat, thereby ensuring good settling, because the controls by the first power supply control and by the second power supply control can be switched, and because either one of the controls is solely performed.

Although in this embodiment the second power supply control is performed where the paper is located at the nipping portion formed with the heat roller and the backup roller, this invention is not limited to this, and for example, the second power supply control can be executed before the front end of the paper reaches the nipping portion. Although in the third and fourth embodiments the prescribed times to be set to the timers are determined based on the information on thickness and size of the paper, sensors such as environmental sensors to measure thickness and size of the paper in addition to the above method can be used. In this embodiment, the power supply control is controlled based on time, but this invention is not limited to this structure, and power supply is controlled based on other values or conditions.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image fixing apparatus comprising:

a fixing unit for fixing a developer image transferred onto a conveyed medium;

a temperature detecting unit for detecting a temperature of the fixing unit;

a first power supply controller for controlling a power supply to the fixing unit based on the detected result of the temperature detecting unit;

a second power supply controller for controlling the power supply to the fixing unit based on a preset value;

a medium detection unit for detecting a medium to be conveyed; and a power supply operation controller for operating the second power supply controller based on a position of the medium detected with the medium detection unit, wherein the power supply operation controller determines whether the second power supply controller is allowed to control the power supply according to a status of the power supply being controlled by the first power supply controller.

2. The image fixing apparatus according to claim 1, wherein the power supply operation controller changes, according to a size or thickness of the medium, a time to start of the power supply operation done by the second power supply controller and a setting of the power supply duration done by the second power supply.

3. An image fixing apparatus comprising:

a fixing unit for fixing a developer image transferred onto a conveyed medium;

a temperature detecting unit for detecting a temperature of the fixing unit;

a first power supply controller for controlling a power supply to the fixing unit based on the detected result of the temperature detecting unit;

a second power supply controller for controlling the power supply to the fixing unit based on a preset value;

a medium detection unit for detecting a medium to be conveyed; and a power supply operation controller for switching control of the power supply between the first power supply controller and the second power supply controller based on a position of the medium detected with the medium detection unit, wherein the power supply operation controller determines whether the second power supply controller is allowed to control the power supply according to a status of the power supply being controlled by the first power supply controller.

4. The image fixing apparatus according to claim 3, wherein the power supply operation controller changes, according to size or thickness of the medium, a time to start of the power supply operation done by the second power supply controller and a setting of the power supply duration done by the second power supply.

5. The image fixing apparatus according to claim 1, wherein the first power supply controller turns on a first heater signal controlling the power supply to the fixing unit where the value detected by the temperature detection unit is lower than a prescribed temperature threshold, wherein the second power supply controller turns on a second heater signal controlling the power supply to the fixing unit after the prescribed time period has passed from when the beginning of the medium is detected by the medium detection unit, and wherein the power supply operation controller supplies electric power to the fixing unit while the first and second heater signals are turned on.

6. The image fixing apparatus according to claim 5, wherein the first power supply controller turns off the first heater signal controlling the power supply to the fixing unit when the value detected by the temperature detection unit exceeds the prescribed temperature threshold, and wherein the second power supply controller turns the second heater signal off after the prescribed time period has passed from when the second heater signal was turned on.

7. The image fixing apparatus according to claim 6, wherein the power supply operation controller supplies electric power to the fixing unit where either the first heater signal or the second heater signal is turned on or both are turned on.

8. The image fixing apparatus according to claim 6, wherein the first heater signal is turned on or off based on a comparison between the signal from the temperature detection unit and the threshold, wherein the threshold is independent of the medium passed to the fixing unit, and wherein the second heater signal is turned on only during the prescribed time period that the medium is passed.

9. The image fixing apparatus according to claim 1, wherein the first power supply controller turns on a first heater signal controlling the power supply to the fixing unit where the value detected by the temperature detection unit is lower than a prescribed temperature threshold, wherein the second power supply controller turns on a second heater signal controlling the power supply to the fixing unit after the prescribed time period has passed from when the beginning of the medium is detected by the medium detection unit, and wherein the power supply operation controller starts supplying electric power to the fixing unit where the first heater signal or the second heater signal is turned on, and the power supply operation controller stops the power supply to the fixing unit when the first heater signal is turned off.

10. The image fixing apparatus according to claim 9, wherein, in a case where the first heater signal is turned off and the second heater signal is turned on, the power supply operation controller starts the power supply to the fixing unit when the second heater signal is turned on, and the power supply operation controller stops the power supply to the fixing unit when the first heater signal is turned off.

11. The image fixing apparatus according to claim 2, wherein the first power supply controller turns on a first heater signal controlling the power supply to the fixing unit where the value detected by the detection unit is lower than the prescribed threshold, wherein the second power supply controller turns on a second heater signal controlling the power supply to the fixing unit after the prescribed time period has passed from the time that the front end of the medium is detected by the medium detection unit, wherein turning-on time of the first heater signal is set to have a longer time period for medium having a long medium size than for medium having a short medium size, wherein turning-on time of the second heater signal is set to have a longer time period for medium having a thicker thickness than for medium having a thinner thickness, and wherein the power supply operation controller supplies electric power to the fixing unit while the first heater signal and the second heater signal are tuned on.

* * * * *